US007787005B2

(12) United States Patent
Nomura et al.

(10) Patent No.: US 7,787,005 B2
(45) Date of Patent: Aug. 31, 2010

(54) PRINT HEAD AND IMAGE FORMING DEVICE USING THE SAME

(75) Inventors: Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 13 days.

(21) Appl. No.: 11/963,462

(22) Filed: Dec. 21, 2007

(65) Prior Publication Data

US 2008/0180515 A1 Jul. 31, 2008

(30) Foreign Application Priority Data

Jan. 26, 2007 (JP) ..... 2007-015938
Oct. 2, 2007 (JP) ..... 2007-258912

(51) Int. Cl.
*B41J 15/14* (2006.01)
*B41J 27/00* (2006.01)

(52) U.S. Cl. ..... 347/241; 347/256

(58) Field of Classification Search ..... 347/130, 347/134, 138, 230, 238, 244, 256, 258, 241, 347/237; 399/93; 313/506
See application file for complete search history.

(56) References Cited

U.S. PATENT DOCUMENTS 5,337,074 A * 8/1994 Thornton ..... 347/237
5,376,994 A * 12/1994 Mama et al. ..... 399/93
5,539,444 A * 7/1996 Ikeda et al. ..... 347/241
6,476,551 B1 * 11/2002 Osawa et al. ..... 313/506
6,844,888 B2 * 1/2005 Nakamura ..... 347/138
7,432,947 B2 * 10/2008 Yosuke ..... 347/244

FOREIGN PATENT DOCUMENTS

JP 60015622 A * 1/1985
JP 11048526 A * 2/1999
JP 2002-170662 6/2002
JP 2006159492 A * 6/2006

* cited by examiner

*Primary Examiner*—Hai C Pham
(74) *Attorney, Agent, or Firm*—Hogan Lovells US LLP

(57) ABSTRACT

A print head includes a plurality of light emitting elements grouped into a plurality of light emitting element groups and disposed by the light emitting group, a lens array having optical systems corresponding respectively to the light emitting element groups, each of the optical systems imaging a light beam emitted from the light emitting element group on a scan target surface, and a light shielding member provided with light guide holes corresponding respectively to the light emitting element groups, each of the light guide holes guiding the light beam emitted from the light emitting element group, wherein each of the light emitting element groups is provided with an aperture section disposed at a front focal position of the optical system and a center axis one of substantially identical and identical to an optical axis of the optical system.

16 Claims, 16 Drawing Sheets

PRINT HEAD AND IMAGE FORMING DEVICE USING THE SAME

BACKGROUND

1. Technical Field

The present invention relates to a print head for scanning a light beam onto a scan target surface and an image forming device using the print head.

2. Related Art

As a light emitting element provided with an optical lens, which can be used for a print head, a light emitting element described, for example, in a document 1 (JP-A-2002-170662, paragraph 6-7, FIG. 8) has been proposed. The light emitting element described in the document 1 is formed on an opening section of a light guide hole, which is a through hole provided to a substrate, on one surface of the substrate. Further, the opening section thereof on the other surface of the substrate is provided with an imaging lens, as an optical lens, bonded thereto. Here, the light guide hole is a columnar hole perpendicular to both of the one surface and the other surface of the substrate. In a print head using the light emitting element described above, a light beam emitted from the light emitting element is guided to the imaging lens by the light guide hole, and focused by the imaging lens to form a spot on a scan target surface.

However, in such a print head as described above, since the light guide hole is the columnar hole perpendicular to both the one surface and the other surface of the substrate, the inside diameter of the light guide hole is constant in the thickness direction. Therefore, the opening section of the light guide hole on the other surface thereof abutting on the imaging lens as an optical lens functions as an aperture section defining the light beam input directly to the imaging lens. As described above, the aperture section is positioned nearer to the imaging lens than the front focal position of the imaging lens. Therefore, most of loci of principal rays respectively passing through the centers of the light beams passing through the opening section (the aperture section) of the light guide hole on the other surface thereof do not pass through the front focal point. Therefore, most of the loci of the principal rays emitted from the imaging lens fail to be substantially parallel to the optical axis of the imaging lens, and enter the scan target surface at various angles. Further, the loci of the light beams other than the principal rays converge respectively on the loci of the principal rays by passing through the imaging lens. According to these circumstances, a ratio in length between an adjacent spot distance and a constant spot pitch varies in conjunction with a variation in the distance between the imaging lens and the scan target surface. The adjacent spot distance is defined as a distance between two spots on the scan target surface corresponding respectively to one and the other of two adjacent light emitting elements the closest to each other belonging respectively two light emitting element groups having the smallest group pitch from each other. As a result, there arises a problem that a plurality of spots having the spot pitch and the adjacent spot distance different in length from each other is formed on the scan target surface. Further, in the image forming device using such a print head, there arises a problem that an undesired shading pattern is apt to be caused to degrade images.

SUMMARY

According to an aspect of the invention, there is provided a print head including a plurality of light emitting elements grouped into a plurality of light emitting element groups and disposed by the light emitting group, a lens array having optical systems corresponding respectively to the light emitting element groups, each of the optical systems imaging a light beam emitted from the light emitting element group on a scan target surface, and a light shielding member provided with light guide holes corresponding respectively to the light emitting element groups, each of the light guide holes guiding the light beam emitted from the light emitting element group, wherein each of the light emitting element groups is provided with an aperture section disposed at a front focal position of the optical system and a center axis one of substantially identical and identical to an optical axis of the optical system.

Further, according to another aspect of the invention, there is provided an image forming device including a latent image holding unit having a surface fed in a predetermined feeding direction, and a print head for forming a latent image on the surface of the latent image holding unit, wherein a print head includes a plurality of light emitting elements grouped into a plurality of light emitting element groups and disposed by the light emitting group, a lens array having optical systems corresponding respectively to the light emitting element groups, each of the optical systems imaging a light beam emitted from the light emitting element group on the surface of the latent image holding unit, and a light shielding member provided with light guide holes corresponding respectively to the light emitting element groups, each of the light guide holes guiding the light beam emitted from the light emitting element group to the optical system, and each of the light emitting element groups is provided with an aperture section disposed at a front focal position of the optical system and a center axis one of substantially identical and identical to an optical axis of the optical system.

According to these aspects of the invention (the print head and the image forming device), each of the light emitting element groups is provided with an aperture section disposed at a front focal position of the optical system and a center axis substantially identical or identical to an optical axis of the optical system. According to this configuration, most of the loci of the principal rays out of the loci of the plurality of light beams passing through the aperture section pass through the front focal point. Therefore, most of the loci of the principal rays emitted from the optical system become parallel to the optical axis of the optical system, and enter the scan target surface or the surface (hereinafter collectively referred to as the "scan target surface") of the latent image holding unit in a substantially perpendicular manner. Further, the loci of the light beams other than the principal rays converge respectively on the loci of the principal rays by passing through the optical system. According to these circumstances, a ratio in length between an adjacent spot distance and a predetermined spot pitch can be made constant irrespective of the variation in the distance between the optical system and the scan target surface. The adjacent spot distance is defined as a distance between two spots on the scan target surface corresponding respectively to one and the other of two adjacent light emitting elements the closest to each other belonging respectively two light emitting element groups having the smallest group pitch from each other. As a result, it is possible to form a plurality of spots having the spot pitch and the adjacent spot distance substantially equal in length to each other on the scan target surface.

Here, an aperture section can be provided to the light guide hole, thus the print head can be downsized in the optical axis direction of the optical system.

Further, it is preferable that the light guide hole is configured to have an inside surface not shielding the loci of a plurality of light beams having contact with the inner end of the aperture section.

In this aspect of the invention, since the inside surface of the light guide hole is provided so as not to shield the loci of the plurality of light beams having contact with the inner end of the aperture section, it is possible to prevent the plurality of optical beams from being shielded by the inside surface thereof.

In this aspect of the invention, it is preferable that the light shielding member is a layered body of a plurality of thin plates. In the case in which the light shielding member is configured as described above, the boring process to the thin plate before stacking has less restrictions in processed shape compared to the boring process to a thick plate, and can be executed in a relatively small amount of time, and subsequently, the print head equipped with the light shielding member provided with the light guide holes with various shapes can be obtained with relative ease.

Further, in the case in which such a layered body is used, one of the thin plates provided with an opening can be used as the aperture section. In this case, the thin film plate is provided with both of the functions as the light shielding member and the aperture section, which requires the smaller number of components than the case of forming the light shielding member and the aperture section separately from each other, and is advantageous in cost reduction.

The configuration of the optical system is not particularly limited providing it has a imaging property of imaging the light beam emitted from the light emitting element group on the scan target surface, and the optical system can be formed, for example, with a single lens or a plurality of lenses. Further, it is also possible to form the lens surface out of the lens surfaces provided to the optical system and opposed to the latent image holding unit to be a planar surface, and thus the particles such as the scattered toner particles can be prevented from adhering to and accumulating on the lens surface. Therefore, this aspect of the invention configured as described above can prevent the problem (reduction of the intensity of the light beam passing therethrough) caused by the scattered toner described above from occurring, and is therefore preferable.

It is also possible to have a configuration of providing a cleaning section for cleaning the lens surface opposed to the scan target surface. According to this configuration, even if the particles such as the scattered toner particles adhere to the lens surface opposed to the scan target surface, the particle adhering particles can be removed by the cleaning section.

It is also configured that the aperture area of the aperture section becomes smaller than the areas of the light guide hole on both the light emitting element side and the optical system side from the aperture section. Thus, the stray light existing inside the light guide hole can be blocked to prevent generation of the ghost.

BRIEF DESCRIPTION OF THE DRAWINGS

The invention will now be described with reference to the accompanying drawings, wherein like numbers refer to like elements.

DESCRIPTION OF EXEMPLARY EMBODIMENTS

First Embodiment

A first embodiment of the invention will hereinafter be explained along the accompanying drawings.

Figure 1:
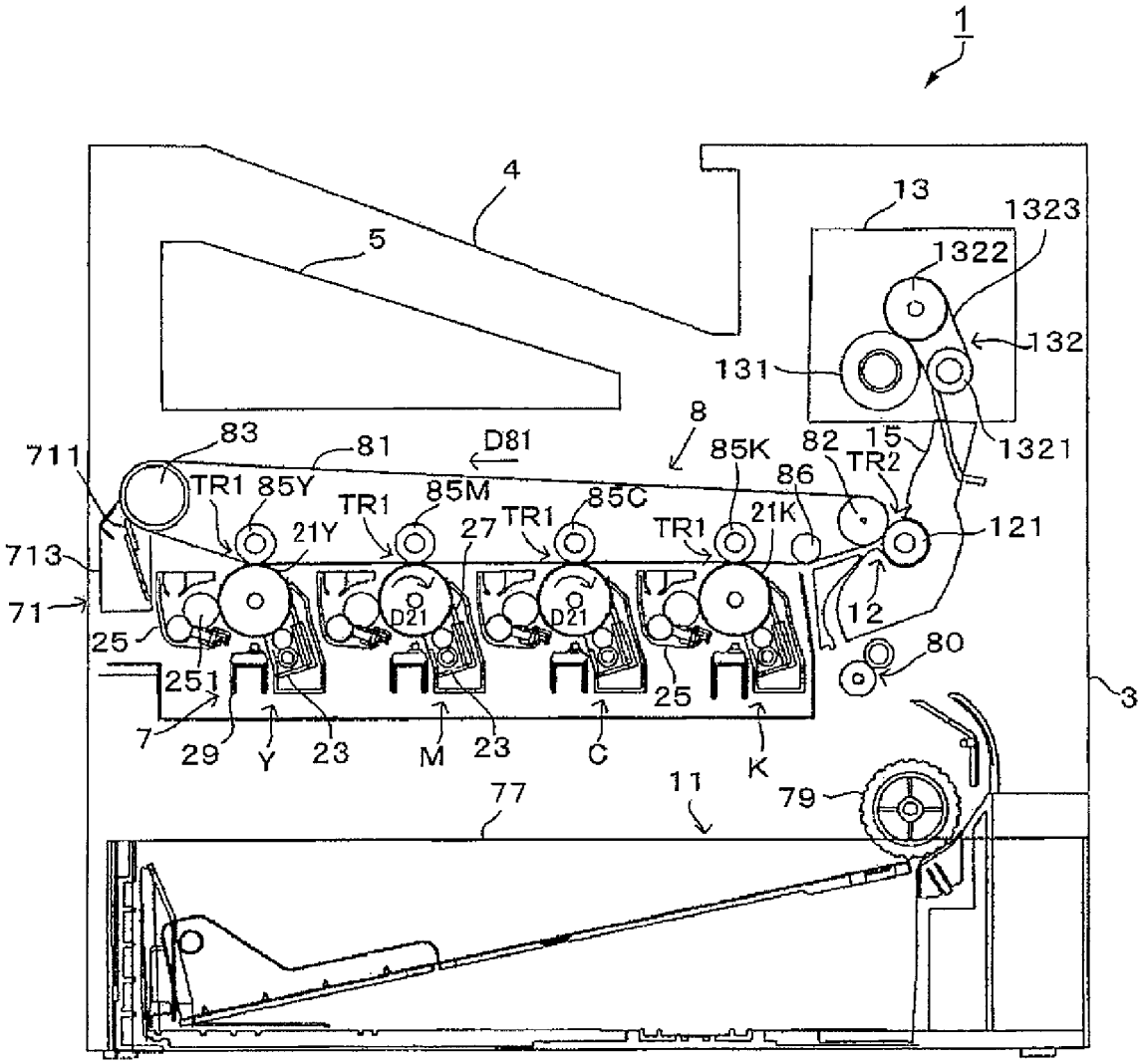
FIG. 1 is a diagram showing a first embodiment of an image forming device according to the invention.
Figure 2:
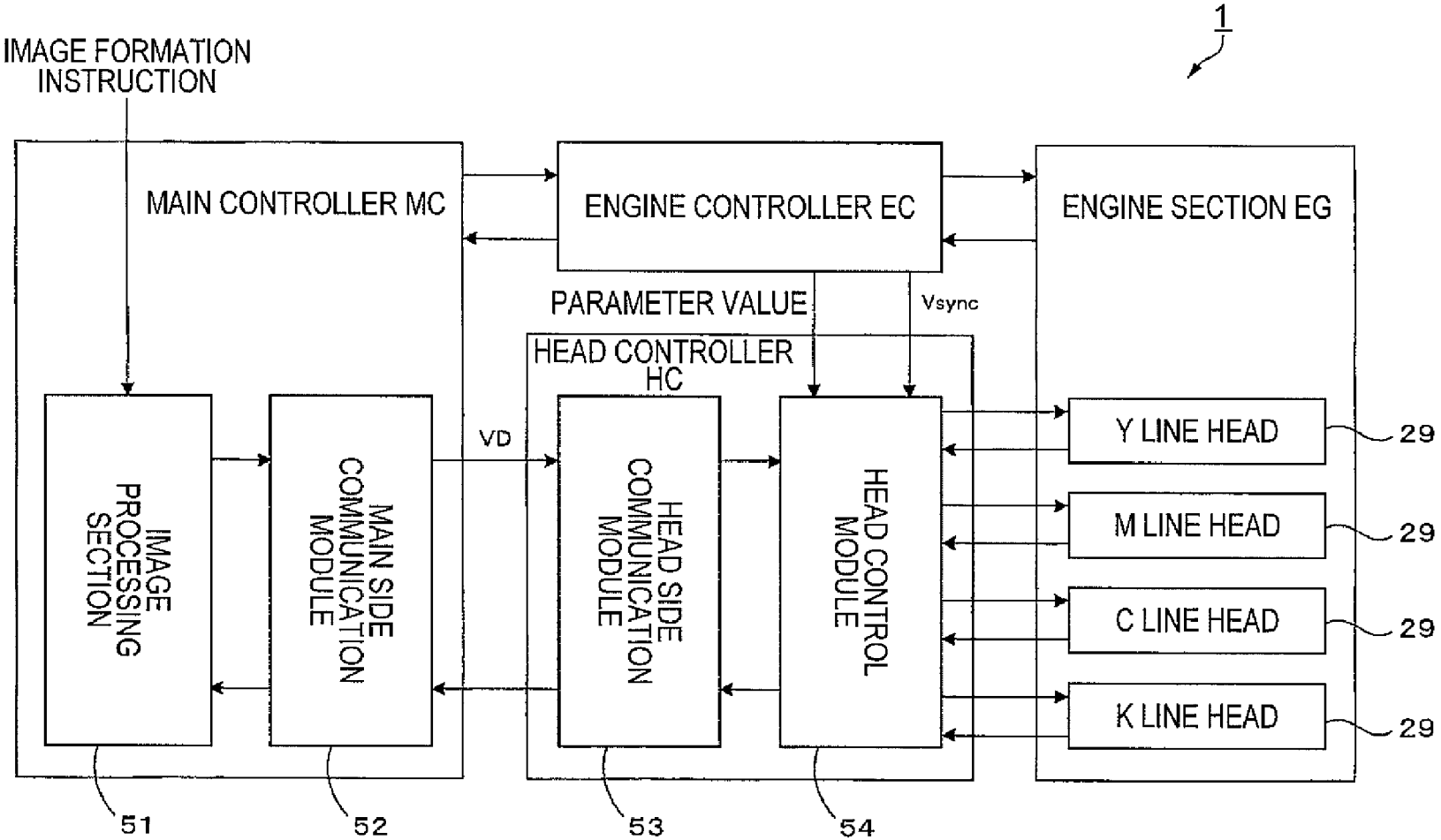
FIG. 2 is a diagram showing an electrical configuration of the image forming device shown in FIG. 1.

FIG. 1 is a diagram showing a first embodiment of an image forming device according to the invention. Further, FIG. 2 is a diagram showing an electrical configuration of the image forming device shown in FIG. 1. The image forming device 1 is capable of selectively performing a color mode in which a color image is formed by overlapping four colors of toners of black (K), cyan (C), magenta (M), and yellow (Y), and a monochrome mode in which a monochrome image is formed using only the black (K) toner. It should be noted that FIG. 1 is a drawing corresponding to a state when performing the color mode. AS shown in FIG. 2, in the image forming device 1, when an image formation instruction is provided to a main controller MC having a CPU, a memory, and so on from an external device such as a host computer, the main controller MC provides an engine controller EC with a control signal, and a head controller HC with the video data VD corresponding to the image formation instruction. Further, the head controller HC controls line heads 29 as print heads for respective colors based on the video data VD from the main controller MC and a vertical sync signal Vsync and parameter values from the engine controller EC. Thus, an engine section EG performs a prescribed image forming operation, thereby forming an image corresponding to the image formation instruction on a sheet such as copy paper, transfer paper, a form, or an OHP transparent sheet.

As shown in FIG. 1, inside a main housing 3 provided to the image forming device 1 according to the present embodiment, there is provided an electrical component box 5 housing a power supply circuit board, the main controller MC, the engine controller EC, and the head controller HC. Further, an image forming unit 7, a transfer belt unit 8, and a paper feed unit 11 are also disposed inside the main housing 3. Further, inside the main housing 3 and on the right side thereof, there are disposed a secondary transfer unit 12, a fixing unit 13, and a sheet guide member 15. It should be noted that the paper feed unit 11 is configured so as to be detachably mounted to the image forming device 1. Further, it is arranged that the paper feed unit 11 and the transfer belt unit 8 can separately be detached from the image forming device 1 to be repaired or replaced.

The image forming unit 7 is provided with four image forming stations Y (for yellow), M (for magenta), C (for cyan), and K (for black) for forming images with different colors from each other. Further, each of the image forming stations Y, M, C, and K is provided with a photoconductor drum 21 as a latent image holding unit having a surface on which a toner image with corresponding color is formed. Each of the photoconductor drums 21 is connected to a dedicated drive motor, and is driven to rotate at a predetermined speed in a direction of an arrow D21 in the drawing. Thus, it is arranged that the surface of each of the photoconductor drum 21 is fed in the sub-scanning direction. Further, around each of the photoconductor drums 21, there are disposed along the rotational direction, a charging section 23, the line head 29, a developing section 25, and a photoconductor cleaner 27. Further, a charging operation, a latent image forming operation, and a toner developing operation are executed by these functional sections. Therefore, when executing the color mode, the toner images respectively formed by all of the image forming stations Y, M, C, and K are overlapped on a transfer belt 81 provided to a transfer belt unit 8 to form a color image, and when executing the monochrome mode, a monochrome image is formed using only the toner image formed by the image forming station K. It should be noted that in FIG. 1, since the image forming stations in the image forming unit 7 have the same configurations as each other, the reference numerals are provided to only a part of the image forming stations, and are omitted in the rest of the image forming stations only for the sake of convenience of illustration.

The charging section 23 is provided with a charging roller having a surface made of elastic rubber. The charging roller is configured so as to be rotated by the contact with the surface of the photoconductor drum at a charging position, and is rotated in conjunction with the rotational operation of the photoconductor drum 21 in a driven direction with respect to the photoconductor drum 21 at a circumferential speed. Further, the charging roller is connected to a charging bias generating section (not shown), accepts the power supply for the charging bias from the charging bias generating section, and charges the surface of the photoconductor drum 21 at the charging position where the charging section 23 and the photoconductor drum 21 have contact with each other.

The line head 29 is a plurality of light emitting elements arranged in a shaft direction (a direction perpendicular to the sheet of FIG. 1) of the photoconductor drum 21, and is disposed distant from the photoconductor drum 21. Further, the light emitting elements emit light onto the surface of the photoconductor drum 21 charged by the charging section 23 to form the latent image on the surface thereof. It should be noted that in the present embodiment, as shown in FIG. 2, the head controller HC is provided for controlling the line heads 29 for respective colors, and controls each of the line heads 29 based on the video data VD from the main controller MC and the signals from the engine controller EC. In other words, in the present embodiment, the image data included in the image formation instruction is input to an image processing section 51 of the main controller MC. Then, various kinds of image processing are executed on the image data to generate the video data VD for every color, and the video data VD is provided to the head controller HC via a main side communication module 52. Further, in the head controller HC, the video data VD is provided to a head control module 54 via ahead side communication module 53. To the head control module 54, the signal representing the parameter value relating to the formation of a latent image and the vertical sync signal Vsync are provided from the engine controller EC, as described above. Then, the head controller HC generates signals to the line heads 29 of the respective colors for controlling driving the element, and outputs the signals to the respective line heads 29. In this way, the operations of the light emitting elements are appropriately controlled in each of the line heads 29, thus the latent image corresponding to the image formation instruction is formed.

Further, in the present embodiment, the photoconductor drum 21, the charging section 23, the developing section 25, and the photoconductor cleaner 27 of each of the image forming stations Y, M, C, and K are unitized as a photoconductor cartridge. Further, each of the photoconductor cartridges is provided with a nonvolatile memory for storing information regarding the photoconductor cartridge. Further, wireless communication is performed between the engine controller EC and each of the photoconductor cartridges. Thus, the information regarding each of the photoconductor cartridges is transmitted to the engine controller EC, and the information in each of the memories is updated.

The developing section 25 has a developing roller 251 with a surface holding the toner. Further, the charged toner is moved to the surface of the photoconductor drum 21 from the developing roller 251 by a developing bias applied to the developing roller 251 from a developing bias generating section (not shown) electrically connected to the developing roller 251 at the developing position where the developing roller 251 and the photoconductor drum 21 have contact with each other, thereby making the electrostatic latent image formed by the line head 29 visible.

The toner image thus made visible at the developing position is fed in the direction of the arrow D21, namely the rotational direction of the photoconductor drum 21, and then primary-transferred to the transfer belt 81 described in detail later at a primary transfer position TR1 where the transfer belt 81 and each of the photoconductor drums 21 have contact with each other.

Further, in the present embodiment, the photoconductor cleaner 27 is disposed downstream of the primary transfer position TR1 and upstream of the charging section 23 in the direction of the arrow D21, the rotational direction of the photoconductor drum 21 so as to have contact with the surface of the photoconductor drum 21. The photoconductor cleaner 27 remove the residual toner on the surface of the photoconductor drum 21 after the primary transfer to clean the surface thereof by having contact with the surface of the photoconductor drum 21.

The transfer belt unit 8 is provided with a drive roller 82, a driven roller 83 (hereinafter also referred to as a blade-opposed roller 83) disposed on the left of the drive roller 82 in FIG. 1, and the transfer belt 81 stretched across these rollers and circularly driven in the direction (a feeding direction) of the arrow D81 shown in the drawing. Further, the transfer belt unit 8 is provided with four primary transfer rollers 85 (85Y, 85M, 85C, and 85K) disposed inside the transfer belt 81 respectively opposed one-on-one to the photoconductor drums 21 included in the image forming stations Y, M, C, and K when the photoconductor cartridges are mounted. These primary transfer rollers 85 are electrically connected to respective primary transfer bias generating sections (not shown). Further, as described in detail later, when executing the color mode, all of the primary transfer rollers 85 (85Y, 85M, 85C, and 85K) are positioned on the side of the image forming stations Y, M, C, and K as shown in FIG. 1 to press the transfer belt 81 against the photoconductor drums 21 included in the respective image forming stations Y, M, C, and K, thereby forming the primary transfer position TR1 between each of the photoconductor drums 21 and the transfer belt 81. Then, by applying the primary transfer bias to the primary transfer rollers 85 from the primary transfer bias generating section with appropriate timing, the toner images formed on the surfaces of the photoconductor drums 21 are transferred to the surface of the transfer belt 81 at the respective primary transfer positions TR1 to form a color image.

On the other hand, when executing the monochrome mode, the primary transfer rollers 85Y, 85M, and 85C for color printing out of the four primary transfer rollers 85 are separated from the image forming stations Y, M and C respectively opposed thereto, while only the primary transfer roller 85K mainly for monochrome printing is pressed against the image forming station K, thus making only the image forming station K mainly for monochrome printing have contact with the transfer belt 81. As a result, the primary transfer position TR1 is formed only between the primary transfer roller 85K mainly for monochrome printing and the corresponding image forming station K. Then, by applying the primary transfer bias to the primary transfer roller 85K mainly for monochrome printing from the primary transfer bias generating section with appropriate timing, the toner image formed on the surfaces of the photoconductor drum 21 is transferred to the surface of the transfer belt 81 at the primary transfer position TR1 to form a monochrome image.

Further, the transfer belt unit 8 is provided with a downstream guide roller 86 disposed downstream of the primary transfer roller 85K mainly for monochrome printing and upstream of the drive roller 82. Further, the downstream guide roller 86 is arranged to have contact with the transfer belt 81 on a common internal tangent of the primary transfer roller 85K mainly for monochrome printing and the photoconductor drum 21 at the primary transfer position TR1 formed by the primary transfer roller 85K mainly for monochrome printing having contact with the photoconductor drum 21 of the image forming station K.

The drive roller 82 circularly drives the transfer belt 81 in the direction of the arrow D81 shown in the drawing, and at the same time functions as a backup roller of a secondary transfer roller 121. On the peripheral surface of the drive roller 82, there is formed a rubber layer with a thickness of about 3 mm and a volume resistivity of no greater than 100 kΩ·cm, which, when grounded via a metal shaft, serves as a conducting path for a secondary transfer bias supplied from a secondary transfer bias generating section not shown via the secondary transfer roller 121. By thus providing the rubber layer having an abrasion resistance and a shock absorbing property to the drive roller 82, the impact caused by a sheet entering the contact section (a secondary transfer position TR2) between the drive roller 82 and the secondary transfer roller 121 is hardly transmitted to the transfer belt 81, thus the degradation of the image quality can be prevented.

The paper feed unit 11 is provided with a paper feed section including a paper feed cassette 77 capable of holding a stack of sheets and a pickup roller 79 for feeding the sheet one-by-one from the paper feed cassette 77. The sheet fed by the pickup roller 79 from the paper feed section is fed to the secondary transfer position TR2 along the sheet guide member 15 after the feed timing thereof is adjusted by a pair of resist rollers 80.

The secondary transfer roller 121 is provided so as to be able to be selectively contacted with and separated from the transfer belt 81, and is driven to be selectively contacted with and separated from the transfer belt 81 by a secondary transfer roller drive mechanism (not shown). The fixing unit 13 has a rotatable heating roller 131 having a heater such as a halogen heater built-in and a pressing section 132 for biasing the heating roller 131 to be pressed against an object. Then, the sheet with the image secondary-transferred on the surface thereof is guided by the sheet guide member 15 to a nipping section formed with the heating roller 131 and a pressing belt 1323 of the pressing section 132, and the image is thermally fixed in the nipping section at predetermined temperature. The pressing section 132 is composed of two rollers 1321, 1322 and the pressing belt 1323 stretched across the two rollers. Further, it is arranged that by pressing a tensioned part of the surface of the pressing belt 1323 stretched by the two rollers 1321, 1322 against the peripheral surface of the heating roller 131, a large nipping section can be formed with the heating roller 131 and the pressing belt 1323. Further, the sheet on which the fixing process is thus executed is fed to a paper catch tray 4 disposed on an upper surface of the main housing 3

Further, in the image forming device 1, a cleaner section 71 is disposed facing the blade-opposed roller 83. The cleaner section 71 has a cleaner blade 711 and a waste toner box 713. The cleaner blade 711 removes foreign matters such as the toner remaining on the transfer belt 81 after the secondary transfer process or paper dust by pressing a tip section thereof against the blade-opposed roller 83 via the transfer belt 81. Then the foreign matters thus removed are collected into the waste toner box 713. Further, the cleaner blade 711 and the waste toner box 713 are configured integrally with the blade-opposed roller 83. Therefore, as described below, when the blade-opposed roller 83 moves, the cleaner blade 711 and the waste toner box 713 should also move together with the blade-opposed roller 83.

Figure 3:
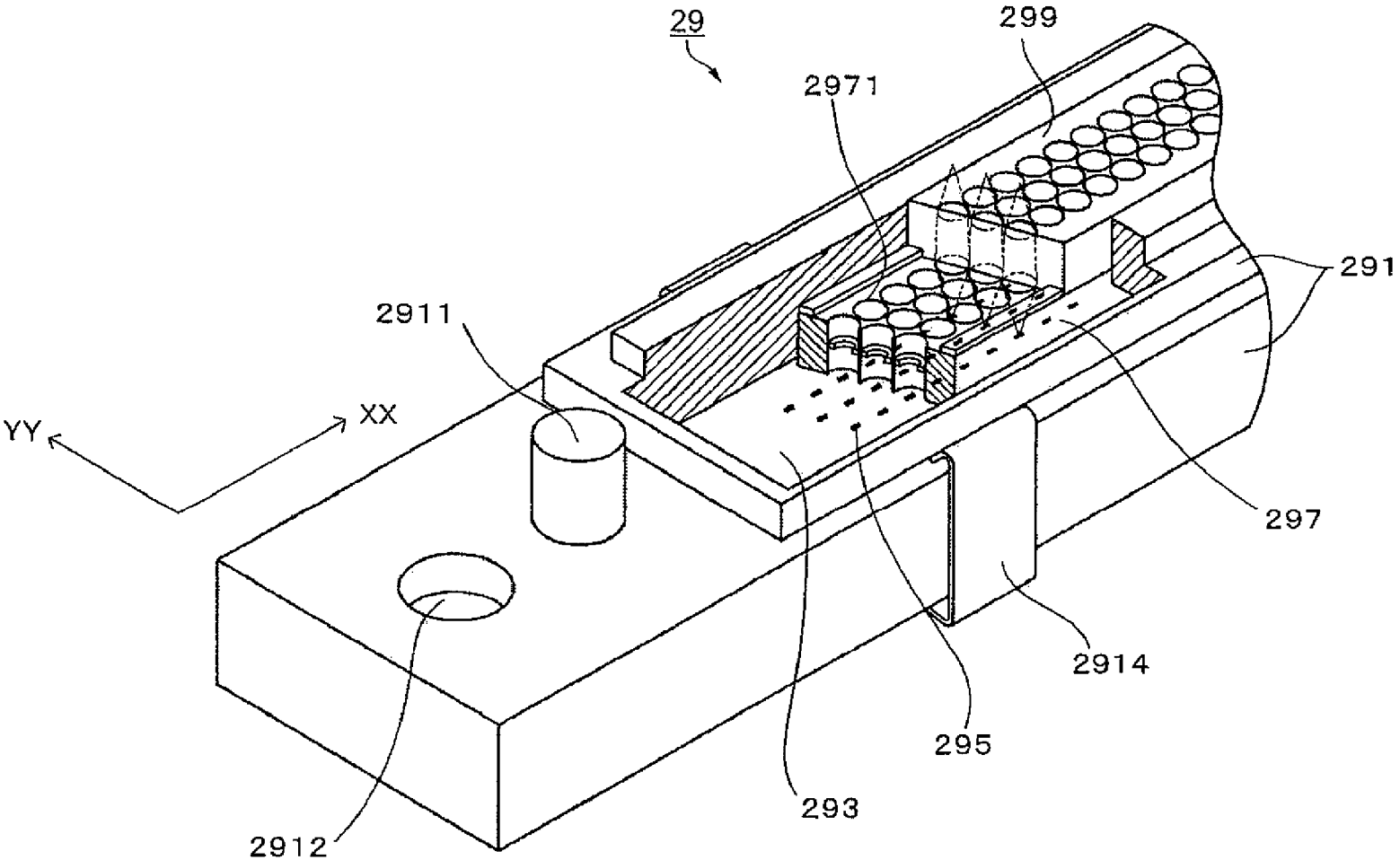
FIG. 3 is a perspective view schematically showing a first embodiment of a print head (a line head).
Figure 4:
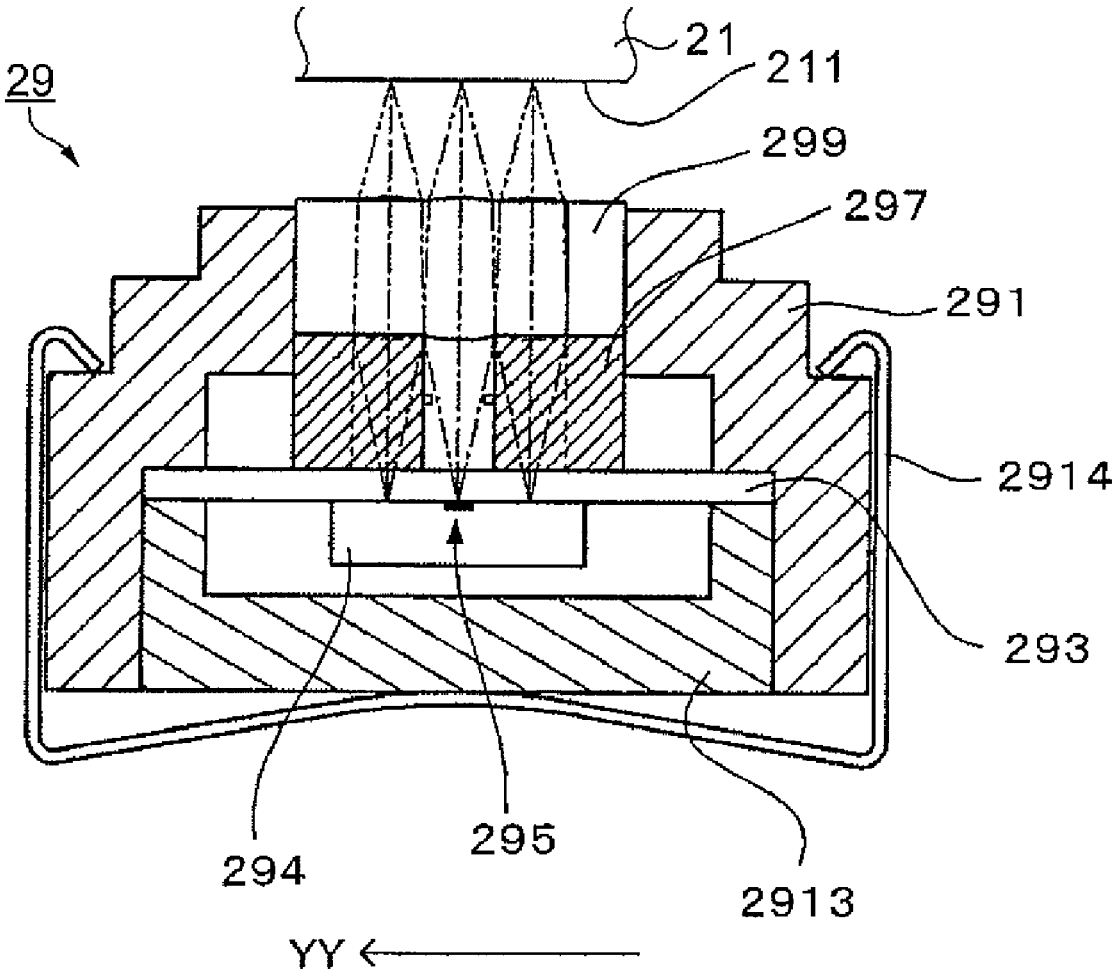
FIG. 4 is a cross-sectional view in a sub-scanning direction, showing the first embodiment of the print head (the line head).

FIG. 3 is a perspective view schematically showing one embodiment of a print head (a line head) according to the invention. Further, FIG. 4 is a cross-sectional view in a sub-scanning direction, showing the one embodiment of the print head (the line head) according to the invention. The line head 29 in the present embodiment is provided with a case 291 having a longitudinal direction identical to the main scanning direction XX, and on each end of the case 291 there are provided a positioning pin 2911 and a screw hole 2912. Further, by fitting the positioning pin into a positioning hole (not shown) provided to a photoconductor cover (not shown) covering the photoconductor drum 21 and positioned to the photoconductor drum 21, the line head 29 is positioned to the photoconductor drum 21. Further, setscrews are screwed in and fixed to the screw holes (not shown) of the photoconductor cover via the screw holes 2912, thereby positioning and fixing the line head 29 to the photoconductor drum 21.

The case 291 holds a microlens array 299 at a position opposed to a scan target surface 211, the surface of the photoconductor drum 21, and is provided with a light shielding member 297 and a glass substrate 293 as a transparent substrate disposed inside thereof in this order from the microlens array 299. Further, on the reverse surface (one of the two surfaces of the glass substrate 293, on the side opposite to the side of the microlens array 299) of the glass substrate 293, there is provided a plurality of light emitting element groups 295. In the present embodiment, an organic electro-luminescence (EL) element is used as the light emitting element. In other words, the organic EL elements are disposed on the reverse surface of the glass substrate 293 as the light emitting elements. Further, a light beam emitted form each of the plurality of light emitting elements towards the photoconductor drum 21 should proceed towards the light shielding member 297 through the glass substrate 293. Here, the light emitting element groups 295 of the organic EL elements are formed taking advantages of the technologies of thin film formation, photolithography, precise etching, and so on. Therefore, the light emitting element groups 295 are superior in accuracy of dimensions such as a distance between the organic EL elements or a distance between the organic EL element groups.

Further, as shown in FIG. 4, a back lid 2913 is pressed by a retainer 2914 against the case 291 via the glass substrate 293. In other words, the retainer 2914 has elastic force for pressing the back lid 2913 towards the side of the case 291, and seals the inside of the case 291 light-tightly (in other words, so that light does not leak from the inside of the case 291 and that light does not enter from the outside of the case 291) by pressing the back lid 2913 with such elastic force. It should be noted that the retainer 2914 is disposed in each of a plurality of positions in the longitudinal direction of the case 291. Further, the light emitting element groups 295 are covered by a seal member 294.

Figure 5:
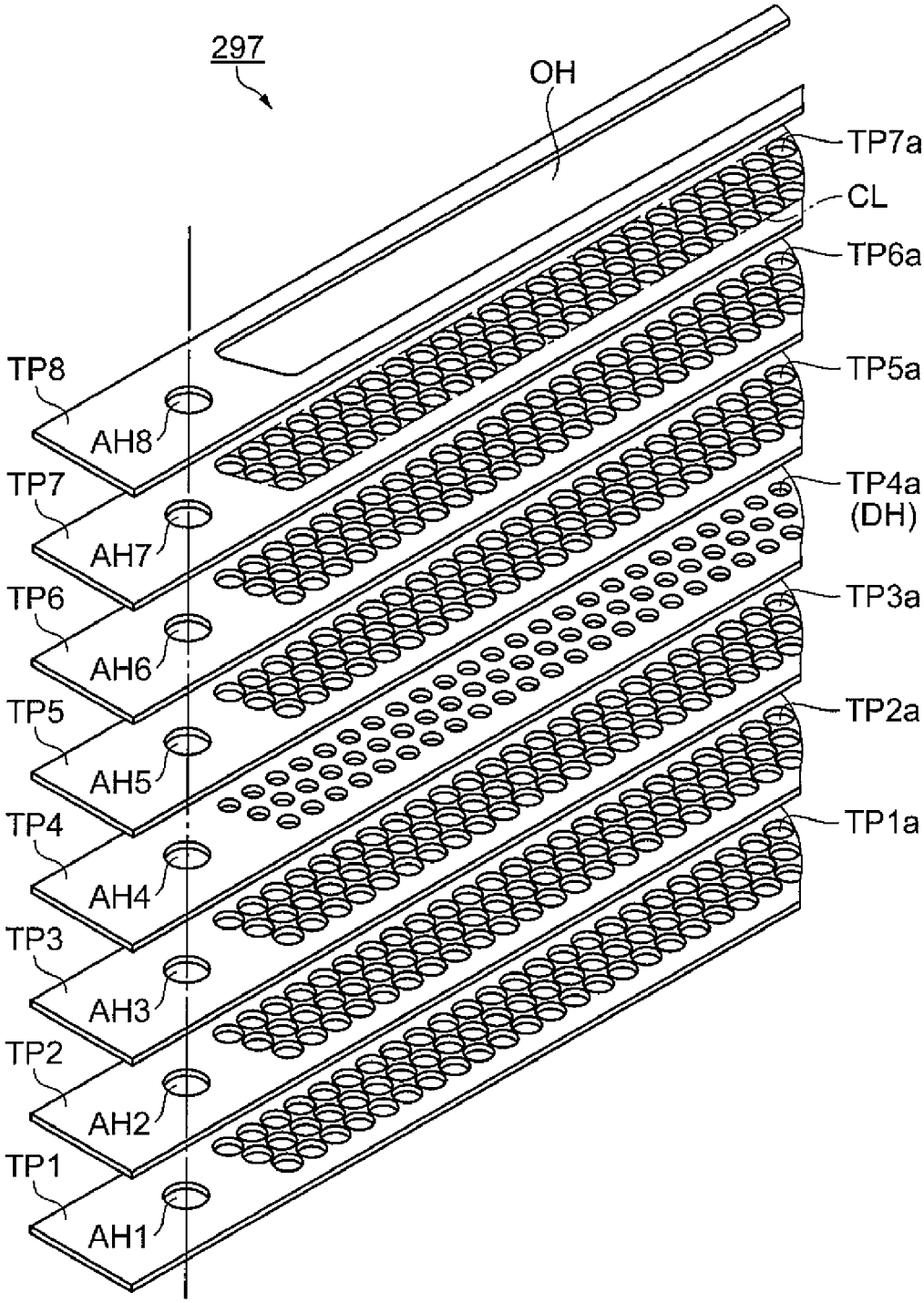
FIG. 5 is an exploded perspective view showing an embodiment of a light shielding member to be stacked.

FIG. 5 is an exploded perspective view showing one example of the light shielding member to be stacked according to the invention. As shown in FIG. 5, the light shielding member 297 is composed of thin plates TP1 through TP8. The thin plates TP1 through TP7 are respectively provided with holes TP1*a* through TP7*a* penetrating the thin plates TP1 through TP7 along a line parallel to the normal line of the glass substrate 293 as the common center axis, and positioning holes AH1 through AH7 (only one end of each of the thin plates is shown, but the other end thereof is not shown) on each of both ends of the thin plates TP1 through TP7, wherein a plurality of sets of holes TP1*a* through TP7*a* is provided. The hole TP4*a* of one thin plate TP4 out of the plurality of thin plates is an aperture section DH. The thin plate TP8 is provided with an opening OH penetrating the thin plate TP8 along a line parallel to the normal line of the glass substrate 293 as the center axis, and a positioning hole AH8 (only one end of the thin plate is shown, but the other end thereof is not shown) on each of both ends of the thin plates TP8. The opening OH has a larger area than the area of a region sectioned by the common external tangents CL of the outermost ones of a plurality of the holes TP7*a*. By applying the thin plate TP8 with an appropriate thickness, the position of the aperture section DH described above is adjusted to be the front focal position of the imaging lens.

Here, the thin plates TP1 through TP8 are made of metal such as carbon steel or titanium. Further, a process for forming the shapes of the thin plates TP1 through TP8 including the shapes of the holes TP1*a* through TP7*a* and the opening OH can be performed by press working or an etching method. In the present embodiment, carbon steel is used for the thin plates TP1 through TP8, and the process for forming the shapes is performed by press working. Further, by bonding the thin plates TP1 through TP8 using, for example, an adhesive containing a gap agent, the light shielding member 297 as a layered body is formed.

Figure 6:
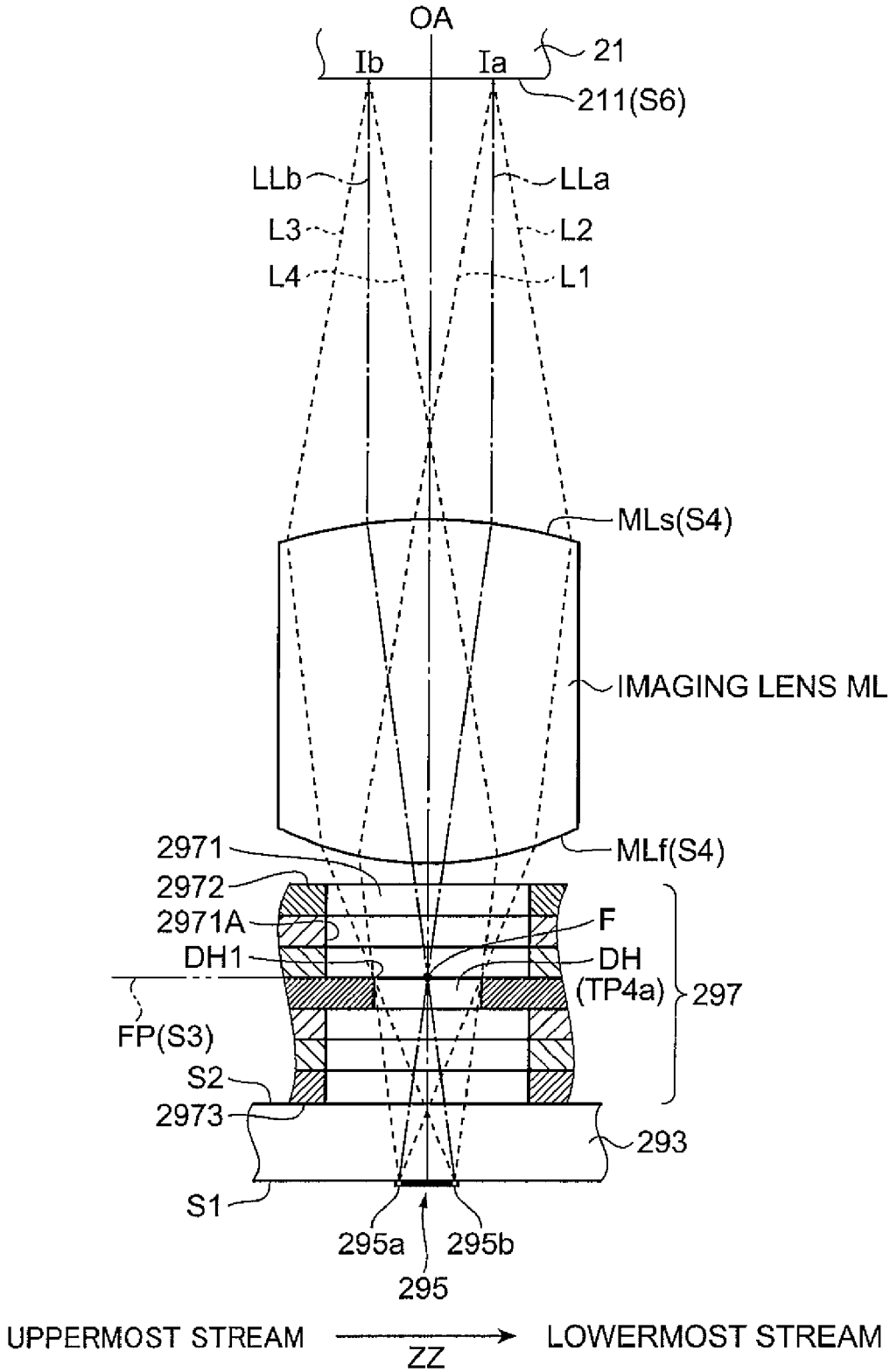
FIG. 6 is a cross-sectional view showing the first embodiment of the print head (the line head) in a specific direction ZZ.

FIG. 6 is a cross-sectional view of one embodiment of the print head (the line head) according to the invention in a specific direction ZZ shown in FIG. 9 described later. A light guide hole 2971 is provided as a hole penetrating the light shielding member 297 along a line parallel to the normal line of the glass substrate 293 as the center axis thereof. Further, the optical axis OA of the imaging lens is substantially identical to the center axis of the aperture section DH.

One example of a locus of a light beam of an uppermost stream light emitting element 295*a*, which is a light emitting element on the uppermost stream and belongs one of the light emitting element groups 295, includes a locus L1, which is a locus of a first light beam entering uppermost stream side of the imaging lens, and a locus L2, which is a locus of a second light beam entering lowermost stream side of the imaging lens. Further, one example of a locus of a light beam of an lowermost stream light emitting element 295*b*, which is a light emitting element on the lowermost stream and belongs the same light emitting element group 295, includes a locus L3, which is a locus of a third light beam entering uppermost stream side of the imaging lens, and a locus L4, which is a locus of a fourth light beam entering lowermost stream side of the imaging lens. The inner end having contact with the loci L1, L2, L3, and L4 for defining the loci L1, L2, L3, and L4 is the inner end DH1 of the aperture section DH. The aperture DH is located between one surface 2972 and the other surface 2973 of the light shielding member 297 and at the front focal position FP of the imaging lens. Further, an inside surface 2971A of the light guide hole 2971 does not block the loci L1, L2, L3, and L4.

A locus LLa is one example of a locus LL of the principal ray of a light beam emitted from the uppermost stream light emitting element 295*a* and passing through the aperture section DH. The locus LLa passes through the front focal point F, and enters the imaging lens. After then, the locus LLa is emitted from the imaging lens, becomes substantially parallel to the optical axis OA of the imaging lens, and then enters a position Ia of the scan target surface 211 substantially perpendicularly thereto. Then, the loci L1 and L2 included in the one example of the locus of the light beam other than the principal ray converge on the locus LLa by passing through the imaging lens. As described above, the light beam emitted from the uppermost stream light emitting element 295*a* is imaged at the position Ia as a spot. A locus LLb is one example of a locus LL of the principal ray of a light beam emitted from the lowermost stream light emitting element 295*b* and passing through the aperture section DH. The locus LLb passes through the front focal point F, and enters the imaging lens. After then, the locus LLb is emitted from the imaging lens, becomes substantially parallel to the optical axis OA of the imaging lens, and then enters a position Ib of the scan target surface 211 substantially perpendicularly thereto. Then, the loci L3 and L4 included in the one example of the locus of the light beam other than the principal ray converge on the locus LLb by passing through the imaging lens. As described above, the light beam output from the lowermost stream light emitting element 295*b* is imaged at the position Ib as a spot.

Figure 7:
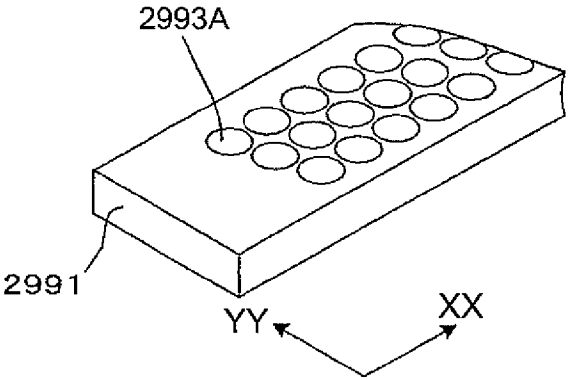
FIG. 7 is a perspective view schematically showing a microlens array.
Figure 8:
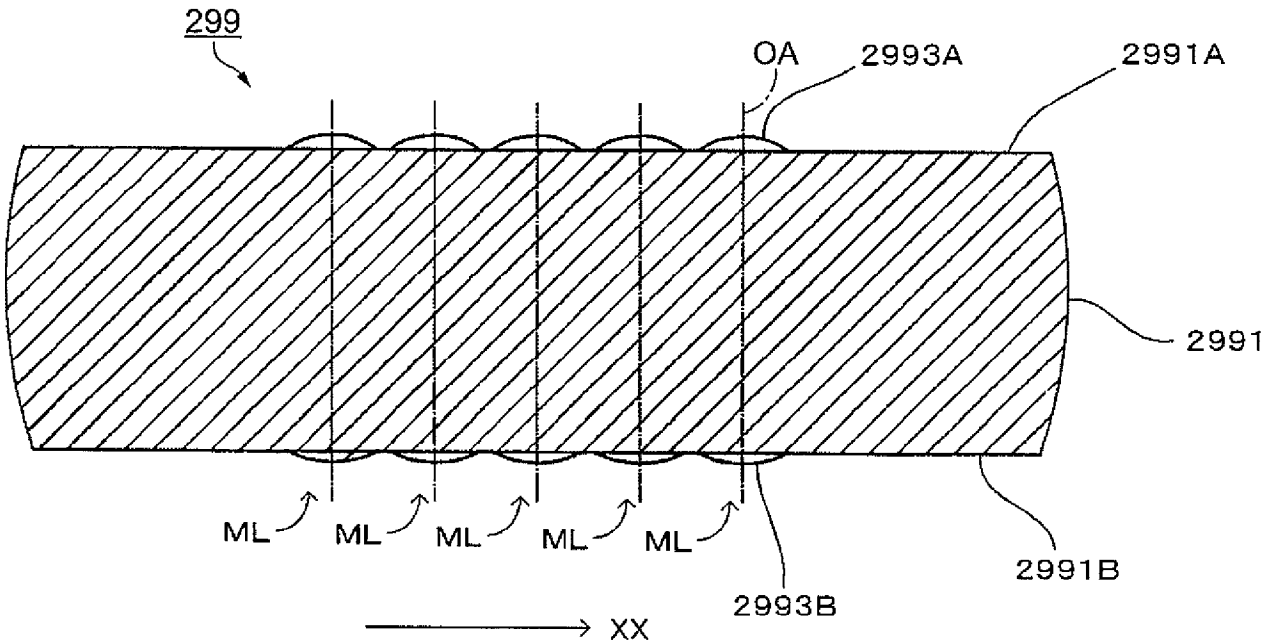
FIG. 8 is a cross-sectional view of the microlens array in a main scanning direction.

FIG. 7 is a perspective view schematically showing the microlens array. Further, FIG. 8 is a cross-sectional view of the microlens array in the main scanning direction. The microlens array 299 has a glass base 2991, and a plurality of pairs of lenses, each pair of lenses being composed of two lenses 2993A, 2993B disposed one-on-one so as to hold the glass base 2991 in between. It should be noted that these lenses 2993A, 2993B can be formed with resin.

In other words, a plurality of lenses 2993A is disposed on the obverse surface 2991A of the glass base 2991, and a plurality of lenses 2993B is disposed on the reverse surface 2991B of the glass base 2991 so as to correspond to the plurality of lenses 2993A one-on-one. Further, the two lenses 2993A, 2993B forming the lens pair have a common optical axis OA. Further, the plurality of lens pairs is disposed so as to correspond to the plurality of light emitting element groups 295 one-on-one. It should be noted that in the present specification, an optical system composed of the lens pair 2993A, 2993B forming a one-on-one pair, and the glass base 2991 held between the lens pair is assumed to be referred to as a "microlens ML." Further, the plurality of lens pairs (microlens ML) is arranged in a tow-dimensional manner corresponding to the arrangement of the light emitting element groups 295.

Figure 9:
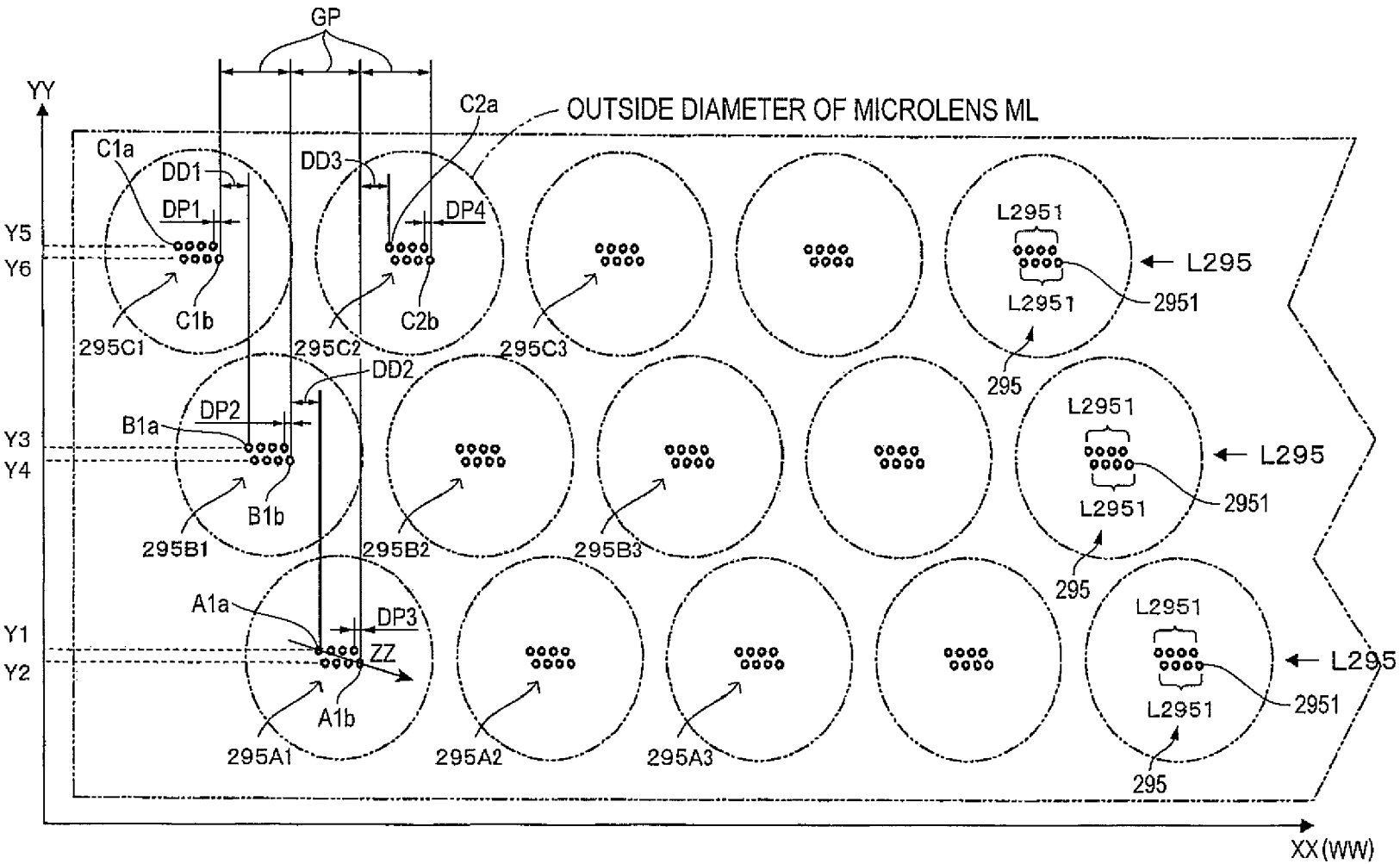
FIG. 9 is a diagram showing an arrangement of a plurality of light emitting element groups.

FIG. 9 is a diagram showing the arrangement of the plurality of light emitting element groups. In the present embodiment, each of the light emitting element groups 295 is composed by arranging two lines of light emitting elements L2951 in the sub-scanning direction YY with a predetermined distance, each of the lines of light emitting elements L2951 being composed by arranging four light emitting elements 2951 in the main scanning direction XX at constant element pitches DP such as pitches DP1, DP2, DP3, and DP4. In other words, the eight light emitting elements 2951 form the light emitting element group 295 corresponding to the microlens ML indicated by a chain double-dashed line circle. Further, the plurality of light emitting element groups 295 is arranged as follows.

That is, the light emitting element groups 295 are arranged in a two-dimensional manner so that three lines of light emitting element groups L295 (a group line) are arranged in the sub-scanning direction YY, each of the three lines of light emitting element groups L295 being composed by arranging a predetermined number (two or more) of light emitting element groups 295 in the main scanning direction XX. Further, all of the light emitting element groups 295 are disposed at positions different from each other in the main scanning direction XX. Further, the plurality of light emitting element groups 295 is arranged so that the light emitting element groups (e.g., the light emitting element groups 295C1, 295B1) having a relationship of forming the shortest length of group pitch GP in the main scanning direction XX as one arranging direction WW, in which the light emitting element groups 295 is arranged, are positioned differently from each other in the sub-scanning direction YY. Here, each of the element pitches DP has a constant value, and each of the group pitches GP also has a constant value. It should be noted that in the present specification, the geometric centroid of the light emitting element 2951 is assumed to be the position of the light emitting element 2951. Therefore, the distance between two light emitting elements denotes the distance between the geometric centroids of the two light emitting elements. Further, in the present specification, "the geometric centroid of the light emitting element group" denotes the geometric centroid of all of the light emitting elements belonging to the same light emitting element group 295. Further, the position in the main scanning direction XX and the position in the sub-scanning direction YY respectively denote a main scanning direction component and a sub-scanning direction component of the position in question.

Further, correspondingly to the positions of such light emitting element groups 295, the light guide holes 2971 are provided to the light shielding member 297 so as to penetrate therethrough, and the lens pairs each composed of the lenses 2993A, 2993B are disposed. In other words, in the present embodiment, it is arranged that the centroid position of the light emitting element group 295, the center axis of the corresponding light guide hole 2971, the center axis of the corresponding aperture section DH, and the optical axis OA of the corresponding lens pair composed of the lenses 2993A, 2993B are substantially identical.

Figure 10:
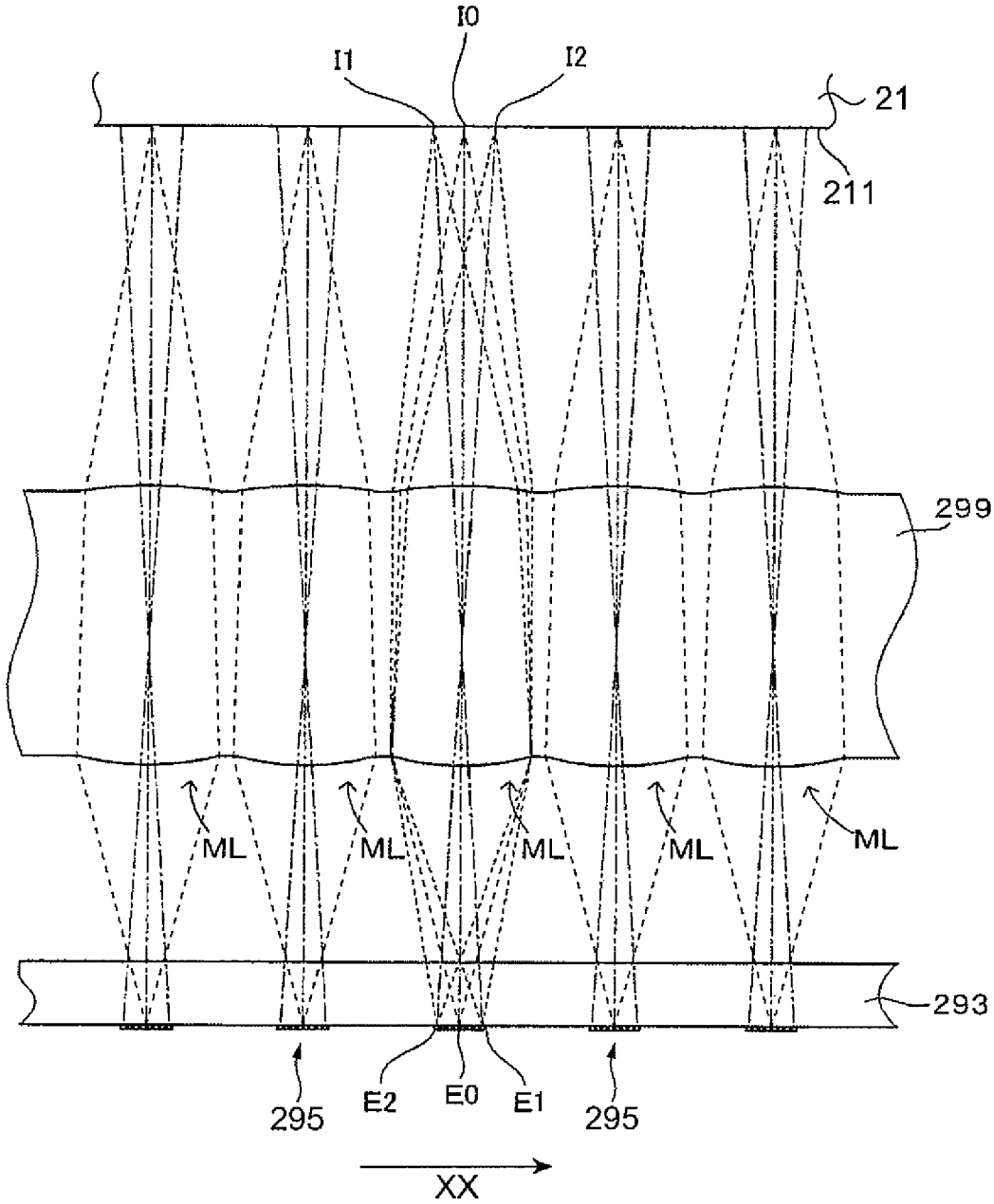
FIG. 10 is a diagram showing an imaging state by the microlens array.

FIG. 10 is a diagram showing an imaging state of each of the light beams emitted from the light emitting elements in the light emitting element line according to the present embodiment by the microlens array. Further, in the drawing, in order for illustrating the imaging characteristics of the microlens array 299, loci LL of the principal rays in the light beams emitted from the geometric centroid E0 of each of the light emitting element group 295 and positions E1, E2, which are the both ends in the horizontal direction of the drawing a predetermined distance distant from the geometric centroid E0 are illustrated with dashed lines, and loci L of the light beams other than the principal rays are illustrated with broken lines. As shown by the loci, the light beam emitted from each of the positions enters the glass substrate 293 from the reverse surface thereof, then passes through the glass substrate 293, and then emitted from the obverse surface side thereof. Then, the optical beam emitted from the obverse surface of the glass substrate 293 reaches the surface (the scan target surface 211) of the photoconductor drum 21 via the microlens array 299. It should be noted that the light emitting element at the position E2 and the position 12 correspond to the uppermost stream light emitting element 295*a* and the position Ia shown in FIG. 6.

As shown in FIGS. 8 and 10, the light beam emitted from the geometric centroid E0 of the light emitting element group is imaged at the intersection I0 between the surface of the photoconductor drum 21 and the optical axis OA of the lenses 2993A, 2993B. This is caused by the fact that, as described above, in the present embodiment, the geometric centroid E0 (the position of the light emitting element group 295) of the light emitting element group 295 is located on the optical axis OA of the lenses 2993A, 2993B. Further, the light beams emitted from the positions E1, E2 are imaged at positions 11, 12 on the surface of the photoconductor drum 21, respectively. In other words, the light beam emitted from the position E1 is imaged at the position I1 on the opposite side of the optical axis OA of the lenses 2993A, 2993B in the main scanning direction XX, and the light beam emitted from the position E2 is imaged at the position 12 on the opposite side of the optical axis OA of the lenses 2993A, 2993B in the main scanning direction XX. Therefore, the imaging lens composed of the lens pair formed of the lenses 2993A, 2993R having the common optical axis and the glass base 2991 held between the pair of lenses is a so-called inverted optical system having an inversion property.

Further, as shown in FIG. 10, the distance between the position I1 and the intersection I0 at which the light beams are respectively imaged is longer compared to the distance between the position E1 and the geometric centroid E0. In other words, an absolute value of a magnification (an optical magnification) of the optical system in the present embodiment is a predetermined value greater than one. In other words, the optical system in the present embodiment is a so-called magnifying optical system having a magnifying property. As described above, in the present embodiment, the microlens ML, which is an optical system composed of the pair of lenses 2993A, 2993B having the common optical axis OA and the glass base 2991 held between the pair of lenses, functions as the "optical system" and the "imaging lens" in the claimed invention.

Figure 11:
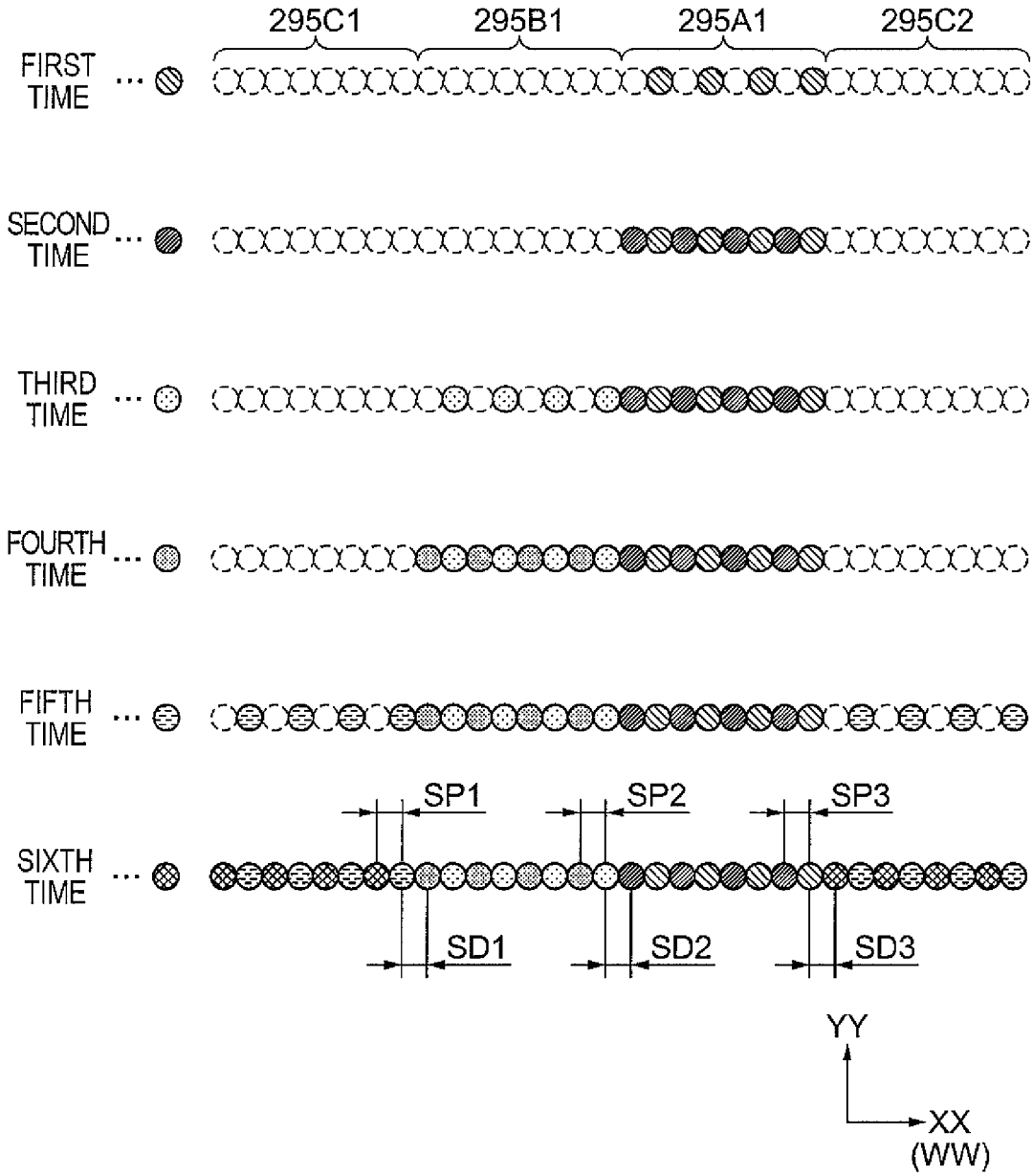
FIG. 11 is a diagram showing a spot forming operation by the line head.

FIG. 11 is a diagram showing a spot forming operation by the line head described above. Hereinafter, the spot forming operation by the line head according to the present embodiment and the spot thus formed will be explained with reference to FIGS. 2, 9, and 11. Further, for facilitating understanding of the invention, the case in which a plurality of spots is formed along a straight line extending in the main scanning direction XX will be explained here. In the present embodiment, the head control module 54 makes a plurality of light emitting elements 2951 emit light with a predetermined timing while feeding the surface (the scan target surface 211) of the photoconductor drum 21 in the sub-scanning direction YY, thereby forming a plurality of spots arranged in a line extending in the main scanning direction XX.

In other words, in the line head of the present embodiment, six light emitting element lines L2951 are arranged in the sub-scanning direction YY correspondingly to sub-scanning directional positions Y1 through Y6, respectively (FIG. 9). Therefore, in the present embodiment, it is arranged that the light emitting elements in the same light emitting element line L2951 are driven to emit light with substantially the same timing, and the light emitting elements in the different light emitting element lines L2951 in the sub-scanning directional positions are driven to emit light with different timing by each of the light emitting element lines. More specifically, the light emitting elements in the light emitting element lines L2951 are driven to emit light by each of the sub-scanning directional positions Y1 through Y6 in this order. Then, the light emitting elements in the light emitting element lines L2951 are driven to emit light in the order described above while feeding the surface (the scan target surface 211) of the photoconductor drum 21 in the sub-scanning direction YY, thereby forming a plurality of spots arranged in a line extending in the main scanning direction XX on this surface.

The operation described above will be explained with reference to FIGS. 9 and 11. Firstly, the light emitting elements 2951 in the light emitting element line L2951 at the sub-scanning directional position Y1 belonging to the light emitting element groups 295A1, 295A2, 295A3, . . . on the uppermost stream in the sub-scanning direction YY are driven to emit light. Then, a plurality of light beams emitted by this emission operation is magnified with a predetermined magnification, while being inverted, to be imaged on the surface (the scan target surface 211) of the photoconductor drum 21 by the "imaging lens" with an inversion magnifying property described above. In other words, the spots are formed at positions with a hatching pattern of "first time" shown in FIG. 11. It should be noted that the outline circles in the drawing each represent a spot which has not yet been formed, and will be formed later. Further, in the drawing, it is shown that the spots labeled with the light emitting element groups 295C1, 295B1, 295A1, and 295C2 are formed by the light emitting element group 295 corresponding to the reference attached thereto.

Then, the light emitting elements 2951 in the light emitting element line L2951 at the sub-scanning directional position Y2 belonging to the light emitting element groups 295A1, 295A2, 295A3, . . . are driven to emit light. Then, a plurality of light beams emitted by this emission operation is magnified with a predetermined magnification, while being inverted, to be imaged on the surface of the photoconductor drum 21 by the "imaging lens" with an inversion magnifying property described above. In other words, the spots are formed at positions with a hatching pattern of "second time" shown in FIG. 11. Here, in order for coping with the fact that the "imaging lens" has the inversion property, the light emission is performed sequentially from the downstream light emitting element line L2951 in the sub-scanning direction YY (i.e., in the order of the sub-scanning directional positions Y1, Y2) despite the fact that the feeding direction of the surface (the scan target surface 211) of the photoconductor drum 21 is the same as the sub-scanning direction YY.

Then, the light emitting elements 2951 in the light emitting element line L2951 at the sub-scanning directional position Y3 belonging to the light emitting element groups 295B1, 295B2, 295B3, . . . on the second uppermost stream in the sub-scanning direction YY are driven to emit light. Then, a plurality of light beams emitted by this emission operation is magnified with a predetermined magnification, while being inverted, to be imaged on the surface (the scan target surface 211) of the photoconductor drum 21 by the "imaging lens" with an inversion magnifying property described above. In other words, the spots are formed at positions with a hatching pattern of "third time" shown in FIG. 11.

Then, the light emitting elements 2951 in the light emitting element line L2951 at the sub-scanning directional position Y4 belonging to the light emitting element groups 295B1, 295B2, 295B3, . . . are driven to emit light. Then, a plurality of light beams emitted by this emission operation is magnified with a predetermined magnification, while being inverted, to be imaged on the surface (the scan target surface 211) of the photoconductor drum 21 by the "imaging lens" with an inversion magnifying property described above. In other words, the spots are formed at positions with a hatching pattern of "fourth time" shown in FIG. 11.

Then, the light emitting elements 2951 in the light emitting element line L2951 at the sub-scanning directional position Y5 belonging to the light emitting element groups 295C1, 295C2, 295C3, . . . on the lowermost stream in the sub-scanning direction are driven to emit light. Then, a plurality of light beams emitted by this emission operation is magnified with a predetermined magnification, while being inverted, to be imaged on the surface (the scan target surface 211) of the photoconductor drum 21 by the "imaging lens" with an inversion magnifying property described above. In other words, the spots are formed at positions with a hatching pattern of "fifth time" shown in FIG. 11.

Finally, the light emitting elements 2951 in the light emitting element line L2951 at the sub-scanning directional position Y6 belonging to the light emitting element groups 295C1, 295C2, 295C3, . . . are driven to emit light. Then, a plurality of light beams emitted by this emission operation is magnified with a predetermined magnification, while being inverted, to be imaged on the surface (the scan target surface 211) of the photoconductor drum 21 by the "imaging lens" with an inversion magnifying property described above. In other words, the spots are formed at positions with a hatching pattern of "sixth time" shown in FIG. 11. As described above, by executing the light emission operations of the first time through sixth time, a plurality of spots is formed to be arranged in the line extending in the main scanning direction XX.

Each of the spot pitches SP1, SP2, and SP3 as one example of the spot pitch SP in the main scanning direction XX on the surface (the scan target surface 211) of the photoconductor drum 21 shown in FIG. 11 has a value obtained by multiplying the respective one of the element pitches DP1, DP2, and DP3 as the element pitch DP shown in FIG. 9 by a predetermined value. Further, each of the pairs, the light emitting element groups 295C1 and 295B1, the light emitting element groups 295B1 and 295 A1, and the light emitting element groups 295A1 and 295C2, is the pair of light emitting element groups having the relationship of forming the shortest group pitch GP therebetween in the main scanning direction XX as one arranging direction WW in which the light emitting element groups 295 is arranged, as shown in FIG. 9. Further, each of the pairs, the light emitting elements C1*b* and B1*a*, the light emitting elements B1*b* and A1*a*, and the light emitting elements A1*b* and C2*a*, is the pair of light emitting elements adjacent to each other having a relationship that one of the light emitting elements is the lowermost stream light emitting element of one of the pair of light emitting element groups having the relationship of the shortest group pitch and the other thereof is the uppermost stream light emitting element of the other thereof. Further, one example of an adjacent element distance DD which is a distance between the light emitting elements adjacent to each other described above is an adjacent element distance DD1, DD2, or DD3. A value obtained by multiplying each of the adjacent element distances DD1, DD2, and DD3 by a predetermined value is the respective one of the adjacent spot distances SD1, SD2, and SD3 as one example of the adjacent spot distance SD shown in FIG. 11. Here, the spot pitches SP1, SP2, and SP3 and the adjacent spot distance SD1, SD2, and SD3 have substantially the same length.

The following advantages can be obtained in the above embodiment.

1. Since the aperture section DH having the center axis substantially identical to the optical axis OA of the imaging lens is disposed in the light guide hole 2971 at the front focal position FP of the imaging lens, most of the loci LL (e.g., the locus La and the locus Lb) of the principal rays out of the loci of a plurality of light beams passing through the aperture section DH pass through the front focal point F. Therefore, most of the loci LL of the principal rays emitted from the imaging lens become substantially parallel to the optical axis OA of the imaging lens, and enter the scan target surface 211 in a substantially perpendicular manner. Further, the loci L (e.g., the loci L1 and L2, or the loci L3 and L4) of the light beams other than the principal rays become to converge on the loci LL of the principal rays by passing through the imaging lens. According to these circumstances, the ratio in length between the adjacent spot distance SD and the constant spot pitch SP can be made constant irrespective of the variation in the distance between the imaging lens and the scan target surface 211. The adjacent spot distance SD is defined as a distance between two spots on the scan target surface 211 corresponding respectively to one and the other of two adjacent light emitting elements the closest to each other belonging respectively two light emitting element groups 295 having the smallest group pitch GP from each other. As a result, a plurality of spots having the spot pitch SP and the adjacent spot distance SD with lengths substantially identical to each other can be formed on the scan target surface 211.

2. Since the inside surface 2971A of the light guide hole 2971, which does not shield the loci of the plurality of light beams having contact with the inner end DH1 of the aperture section DH, is provided, the plurality of light beams can be prevented from being shielded by the inner end 2971A.

3. Since the light shielding member 297 is a layered body of a plurality of thin plates TP, the boring process to the thin plate TP before stacking has less restrictions in processed shape compared to the boring process to a thick plate, and can be executed in a relatively small amount of time, and subsequently, the line head 29 as the print head equipped with the light shielding member 297 provided with the light guide holes 2971 with various shapes can be formed with relative ease.

4. Since the aperture section DH having the center axis substantially identical to the optical axis OA of the imaging lens is disposed in the light guide hole 2971 at the front focal position FP of the imaging lens, most of the loci LL (e.g., the locus La and the locus Lb) of the principal rays out of the loci of a plurality of light beams passing through the aperture section DH pass through the front focal point F. Therefore, most of the loci LL of the principal rays emitted from the imaging lens become substantially parallel to the optical axis OA of the imaging lens, and enter the scan target surface 211 in a substantially perpendicular manner. Further, the loci L (e.g., the loci L1 and L2, or the loci L3 and L4) of the light beams other than the principal rays become to converge on the loci LL of the principal rays by passing through the imaging lens. According to these circumstances, the ratio in length between the adjacent spot distance SD and the constant spot pitch SP can be made constant irrespective of the variation in the distance between the imaging lens and the scan target surface 211. The adjacent spot distance SD is defined as a distance between two spots on the scan target surface 211 corresponding respectively to one and the other of two adjacent light emitting elements the closest to each other belonging respectively two light emitting element groups 295 having the smallest group pitch GP from each other. As a result, a plurality of spots having the spot pitch SP and the adjacent spot distance SD with lengths substantially identical to each other can be formed on the scan target surface 211. Further, in the image forming device 1 using such a line head 29 as an exposure section, frequency of generation of an undesired shading pattern can be reduced, thus the degradation of the image quality can be made difficult.

5. Since the inside surface 2971A of the light guide hole 2971, which does not shield the loci of the plurality of light beams having contact with the inner end DH1 of the aperture section DH, is provided, the image forming device 1 for preventing the plurality of light beams from being shielded by the inner end 2971A can be obtained.

6. Since the light shielding member 297 is a layered body of a plurality of thin plates TP, the boring process to the thin plate TP before stacking has less restrictions in processed shape compared to the boring process to a thick plate, and can be executed in a relatively small amount of time, and subsequently, the image forming device 1 equipped with the light shielding member 297 provided with the light guide holes 2971 with various shapes can be obtained with relative ease.

7. As shown in FIG. 6, it is arranged that the aperture area of the aperture section DH becomes smaller than both the area of the light guide hole on the light emitting element side (the lower side of the drawing) and the area of the light guide hole on the optical system side (the upper side of the drawing). Thus, the stray light existing inside the light guide hole can be blocked to prevent generation of the ghost.

As a specific example of the line head (the print head) having such a function and an advantage, a lens having the lens data shown in Table 1 can be used. The surface numbers S1 through S6 in Table 1 will be explained with reference to FIG. 6. The surface number S1 corresponds to a body surface, namely the reverse surface of the glass substrate 293 on which the light emitting elements 2951 are disposed. The surface number S2 corresponds to the obverse surface of the glass substrate 293. The surface number S3 corresponds to the aperture section DH. As described above, the aperture section DH is disposed at the front focal point F of the imaging lens ML, thus image-side telecentric is realized. The surface number S4 corresponds to a first surface MLf of the imaging lens ML. The surface number S5 corresponds to a second surface MLs of the imaging lens ML. The surface number S6 corresponds to the scan target surface 211, namely the surface of the photoconductor drum (the latent image holding unit). Here, the sum of the surface distances from the surface numbers S1 through S3 gives the lens position. Further, the surface distance of the surface number S4 gives the lens thickness.

TABLE 1

| SURFACE NUMBER | SURFACE TYPE | CURVATURE RADIUS | SURFACE DISTANCE | REFRACTIVE INDEX |
|---|---|---|---|---|
| S1 (BODY SURFACE) | | ∞ | 0.5 | $n_d = 1.5168$; $v_d = 64.2$ |
| S2 | | ∞ | 2.472 | |
| S3 (APERTURE SURFACE) | | ∞ | 0.59 | |
| S4 | ASPHERIC SURFACE | 0.9519 | 1.979 | $n_d = 1.5311$; $v_d = 56$ |
| S5 | ASPHERIC SURFACE | −1.029 | 1.169 | |
| S6 (IMAGE SURFACE) | | ∞ | | |

Table 2 shows aspherical coefficients of the aspheric surfaces S4, S5. Further, Formula I is for giving a shape of an aspheric surface. Therefore, the shapes (in other words, the lens shape of the imaging lens ML) of the aspheric surfaces S4, S5 are determined by Table 2 and Formula 1.

TABLE 2

| SURFACE NUMBER | CURV | K | A |
|---|---|---|---|
| S4 | 1.051 | −1.464 | −9.232E−02 |
| S5 | −0.9718 | −4.959 | −7.974E−02 |

$$Z = \frac{(CURV)h^2}{1 + \sqrt{1 - (1 + K)(CURV)^2 h^2}} + (A)h^4 \quad \text{(Formula 1)}$$

where;

Z: a sag amount of a surface parallel to the z-axis

CURV: curvature at the vertex of the surface

K: a conic coefficient

A: a quartic deformation coefficient $h^2 = x^2 + y^2$ x: a coordinate of x-axis (the main scanning direction)

y: a coordinate of y-axis (the sub-scanning direction)

Table 3 shows specifications of the optical system used in a specific example. Here, the wavelength denotes the wavelength of the light beam emitted from the light emitting element. The lens diameter denotes the diameter of the emission surface of the imaging lens ML, namely of the second surface MLs. Further, the light source diameter denotes the diameter of the light emitting element 2951. Further, in the above specifications, the body height of 0.6 mm denotes that the simulation was executed in the condition that the light beam is emitted from the virtual light emitting element located with the body height of 0.6 mm. In this case, since the magnification is −0.5, the image height becomes −0.3 mm.

TABLE 3

| ITEM | VALUE |
|---|---|
| WAVELENGTH | 630 nm |
| LENS DIAMETER | 1.7 mm |
| BODY HEIGHT | 0.6 mm |
| IMAGE HEIGHT | −0.3 mm |
| MAGNIFICATION | −0.5 |
| LIGHT SOURCE DIAMETER | 40 μm |

Second Embodiment

Figure 12:
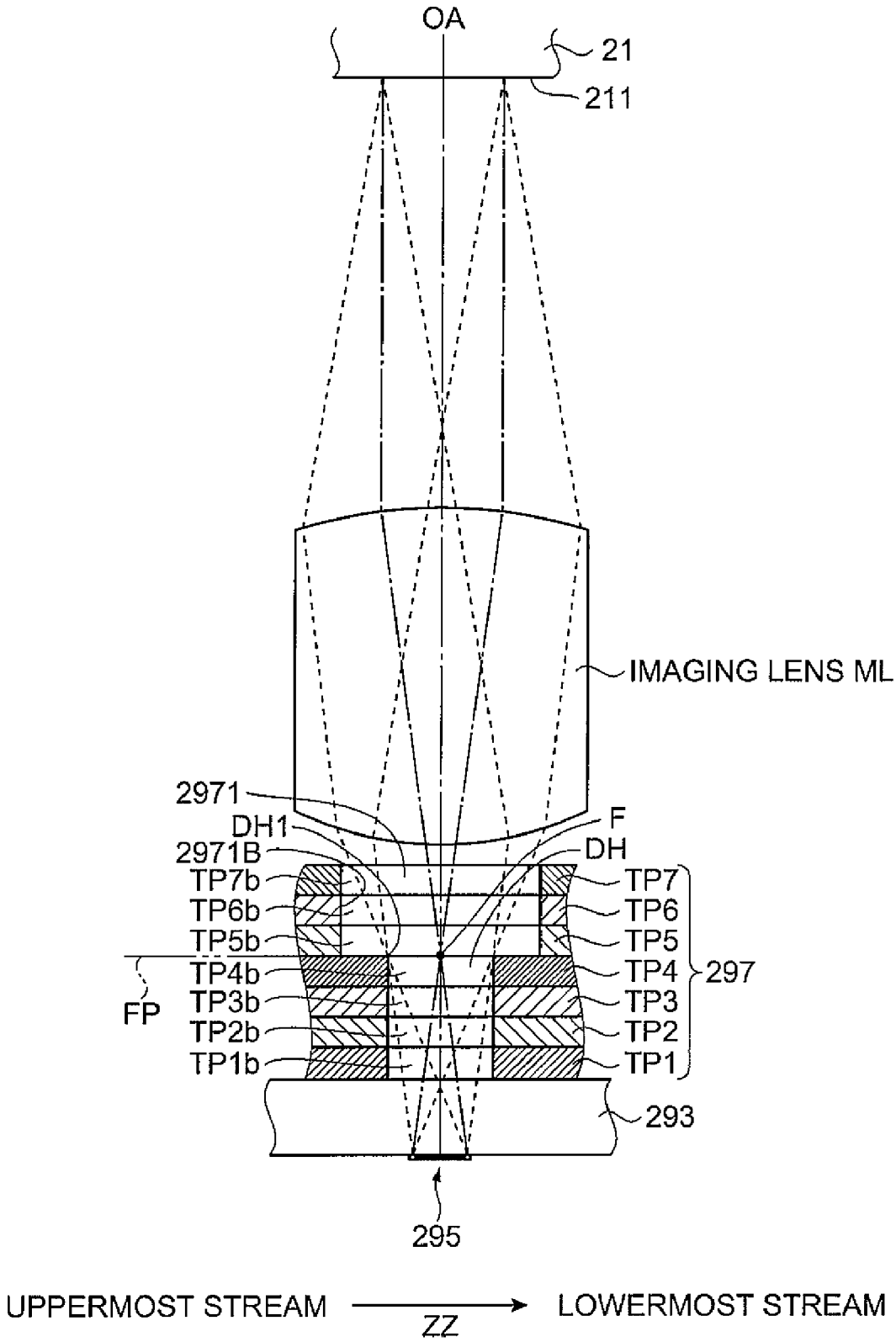
FIG. 12 is a diagram showing a second embodiment of a print head (a line head) according to the invention.

FIG. 12 is a diagram showing a second embodiment of the print head (the line head) according to the invention, and more particularly, a cross-sectional view of a modified example of the print head (the line head) according to the invention along the specific direction ZZ shown in FIG. 9. In the explanations of the second embodiment hereinafter described, those regarding the same contents as in the above embodiment will be omitted, and those regarding different contents therefrom will be included. As shown in FIG. 12, the light shielding member 297 is provided with the thin plates TP1 through TP8 (TP8 is omitted from illustration). Holes TP1*b* through TP3*b* of the thin plates TP1 through TP3 have sizes substantially the same as a hole TP4*b* of the thin plate TP4. In the line head 29 equipped with the light shielding member 297 provided with an inside surface 2971B having a shape shown in this modified example, and in an image forming device 1 equipped with an exposure section having the same configuration as the line head 29, the same advantages as the advantages in the first embodiment can be obtained.

Third Embodiment

Figure 13:
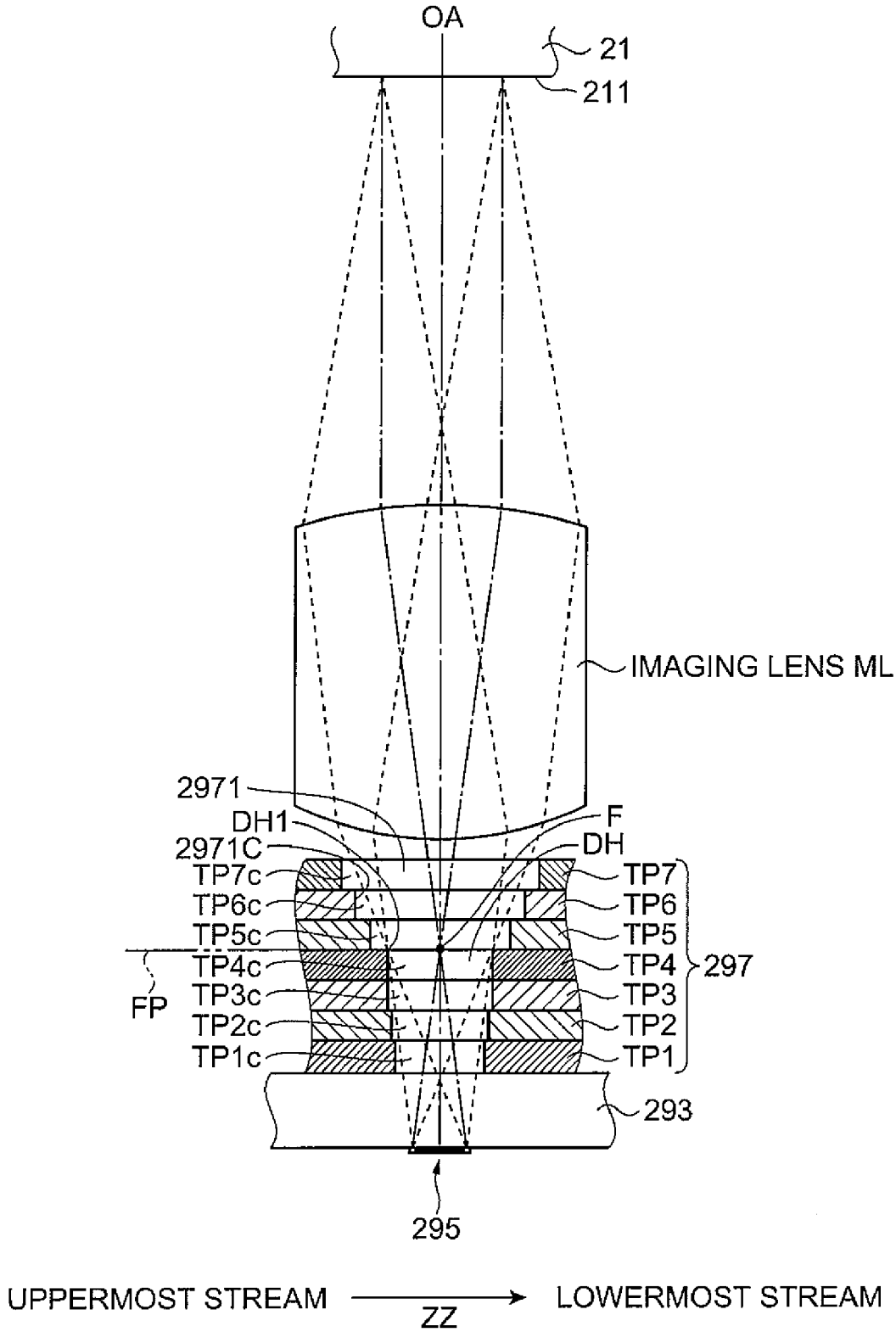
FIG. 13 is a diagram showing a third embodiment of a print head (a line head) according to the invention.

FIG. 13 is a diagram showing a third embodiment of the print head (the line head) according to the invention, and more particularly, a cross-sectional view of another modified example of the print head (the line head) according to the invention along the specific direction ZZ shown in FIG. 9. In the explanations of the third embodiment hereinafter described, those regarding the same contents as in the first or second embodiment will be omitted, and those regarding different contents therefrom will be included. As shown in FIG. 13, the holes TP2*c*, TP1*c* of the thin plates TP2, TP1 have sizes decrease stepwise from the size of the hole TP4*c* of the thin plate TP4. The size of the hole TP3*c* of the thin plate 3 is the same as the size of the hole TP4*c* of the TP4. Further, the sizes of the holes TP5*c* through TP7*c* of the thin plates TP5 through TP7 increase stepwise from the size of the hole TP4*c* of the thin plate TP4. In the line head 29 equipped with the light shielding member 297 provided with an inside surface 2971C having a shape shown in this modified example, and in an image forming device 1 equipped with an exposure section having the same configuration as the line head 29, the same advantages as the advantages in the first or second embodiment can be obtained.

Fourth Embodiment

Figure 14:
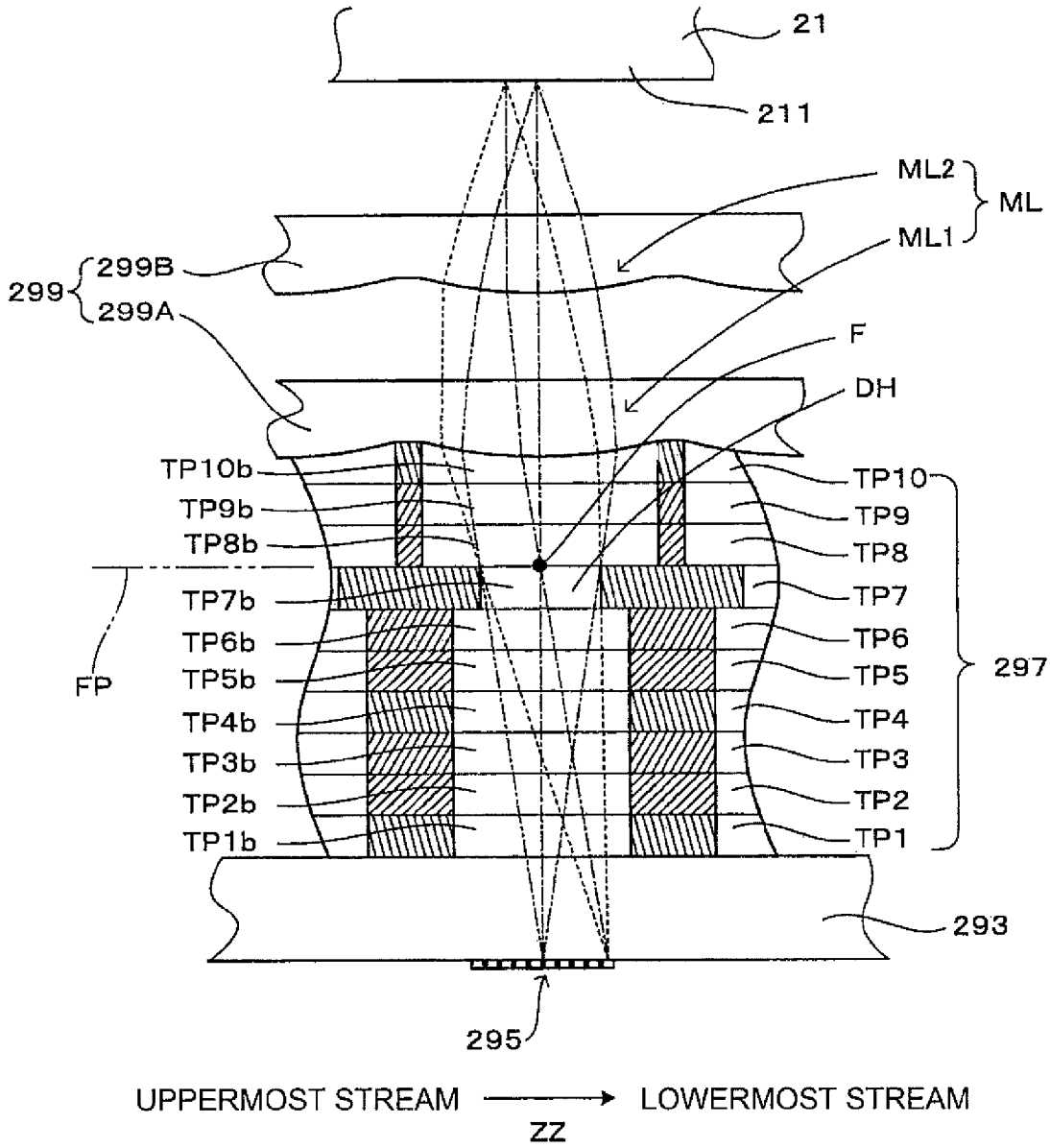
FIG. 14 is a diagram showing a fourth embodiment of a print head (a line head) according to the invention.

FIG. 14 is a diagram showing a fourth embodiment of a print head (a line head) according to the invention. In the explanations of the fourth embodiment hereinafter described, those regarding the same contents as in the first or second embodiment will be omitted, and those regarding different contents therefrom will be included. As shown in FIG. 14, in the fourth embodiment, the microlens array 299 has a configuration of combining two lens arrays 299A, 2998 with each other. In other words, in the lens array 299A, the lens ML1 is disposed on the light source side (the lower side in the drawing) of the glass base for every light emitting element group. On the other hand, in the lens array 2998, the lens ML2 is disposed on the light source side (the lower side in the drawing) of the glass base for every light emitting element group. Thus, the imaging lens ML is formed with the lenses ML1, ML2 correspondingly to each of the light emitting element groups. In other words, the imaging lens ML has a function of imaging the light beams emitted from the light emitting elements on the scan target surface 211 (the surface of the photoconductor drum 21) combining the two plano-convex lenses with each other. In this point, this embodiment is greatly different from the first through third embodiments having the imaging lens (the optical system) formed of a single lens.

The light shielding member 297 is composed of the thin plates TP1 through TP10. These thin plates TP1 through TP10 are respectively provided with holes TP1*a* through TP10*a* penetrating the thin plates TP1 through TP10 along a line parallel to the normal line of the glass substrate 293 as the common center axis, and positioning holes (not shown) on each of both ends of the thin plates TP1 through TP10, wherein a plurality of sets of holes TP1*a* through TP10*a* is provided. The hole TP7*a* of one thin plate TP7 out of the plurality of thin plates is the aperture section DH. Further, the hole TP10*a* of the thin plate TP10 the closest to the optical system (the microlens array 299) of all of the thin plates has a diameter equal to or a little bit greater than that of the lens ML1, and the microlens array 299 is aligned with the light shielding member 297 in both the direction of the optical axis of the microlens array 299 and the direction perpendicular to the optical axis thereof by fitting the hole TP10*a* with the lens ML1.

It should be noted that in the present embodiment, the holes TP1*a* through TP6*a* provided to the thin plates TP1 through TP6 located on the light emitting element side of the aperture section DH have the same diameters, thus forming the "light guide hole on the light emitting element side" of the invention. On the other hand, the holes TP8*a* through TP10*a* provided to the thin plates TP8 through TP10 located on the optical system (the microlens array 299) side of the aperture section DH have the same diameters, thus forming the "light guide hole on the optical system side" of the invention. In comparing the area of the light guide hole thus formed with the aperture area of the aperture section DH, the aperture area of the aperture section DH is arranged to be smaller than the area of the light guide hole on the light emitting element side and the area of the light guide hole on the optical system side. Moreover, by optimizing the number or the thickness of the thin plates TP8 through TP10, it becomes possible to adjust the aperture section DH described above to be positioned in the front focal position of the imaging lens ML.

Figure 15:
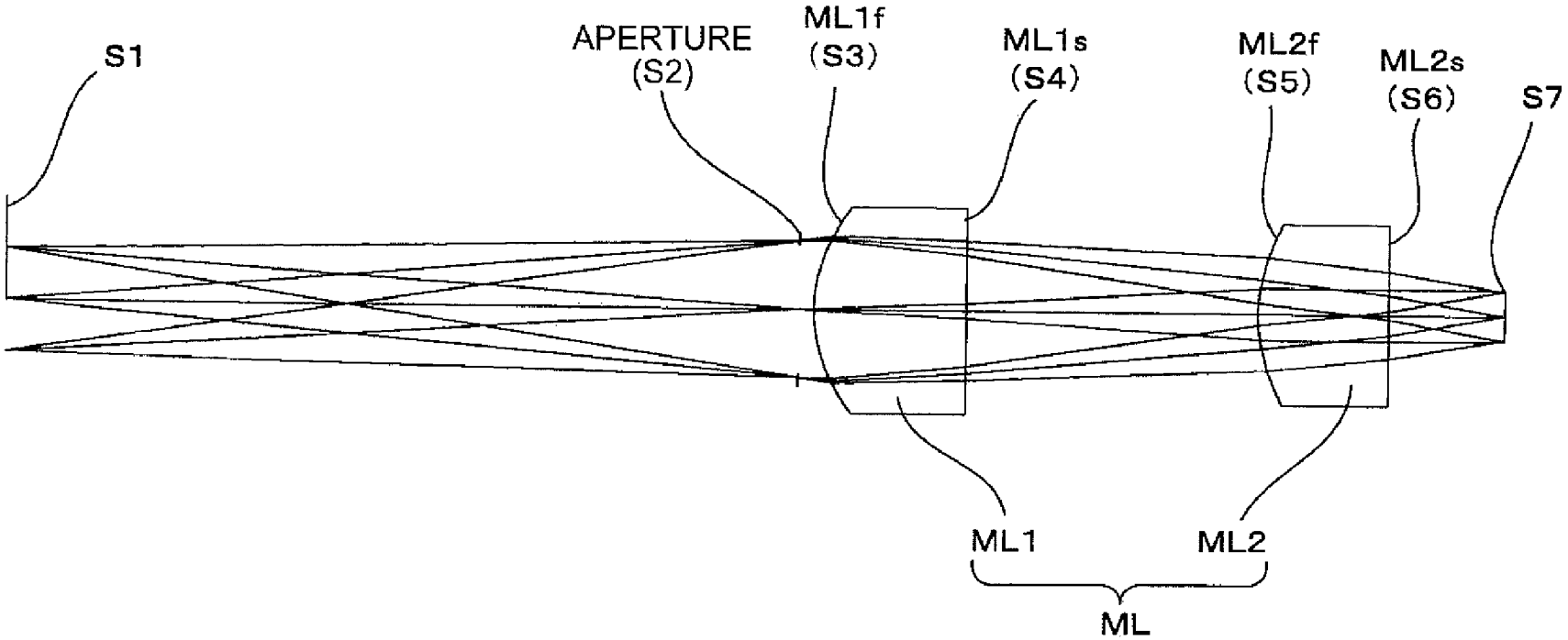
FIG. 15 is a diagram showing an imaging state by the microlens array.

As an example of the fourth embodiment thus configured, a lens having the lens data shown in Table 4 can be used. The surface numbers S1 through S7 in Table 4 will be explained with reference to FIG. 15. The surface number S1 corresponds to a body surface, namely the reverse surface of the glass substrate 293 on which the light emitting elements 2951 are disposed. The surface number S2 corresponds to the aperture section DH. As described above, the aperture section DH is disposed at the front focal point F of the imaging lens ML, thus image-side telecentric is realized. The surface number S3 corresponds to a first surface ML1*f* of the first lens ML1. The surface number S4 corresponds to a second surface ML1*s* of the first lens ML1. The surface number S5 corresponds to a first surface ML2*f* of the second lens ML2. The surface number S6 corresponds to a second surface ML2s of the second lens ML2. The surface number S7 corresponds to the scan target surface 211, namely the surface of the photoconductor drum (the latent image holding unit).

TABLE 4

| SURFACE NUMBER | SURFACE TYPE | CURVATURE RADIUS | SURFACE DISTANCE | REFRACTIVE INDEX |
|---|---|---|---|---|
| S1 (BODY SURFACE) | | ∞ | 5.128 | |
| S2 (APERTURE SURFACE) | | ∞ | 0.187 | |
| S3 | ASPHERIC SURFACE | 1.347 | 1.000 | $n_d = 1.5168$; $v_d = 64.2$ |
| S4 | | ∞ | 1.900 | |
| S5 | ASPHERIC SURFACE | 1.423 | 0.850 | $n_d = 1.5168$; $v_d = 64.2$ |
| S6 | | ∞ | 0.750 | |
| S7 (IMAGE SURFACE) | | ∞ | 0.000 | |

As apparent from Table 4, both of the lenses ML1, ML2 are plano-convex lenses, and the lens surfaces S3, S5 are aspheric surfaces. Further, the aspherical coefficients of the lens surfaces S3, S5 are shown in Table 5. Further, Formula 1 is for giving a shape of an aspheric surface. Therefore, the shapes (in other words, the lens shape of the imaging lens ML) of the aspheric surfaces S3, S5 are determined by Table 5 and Formula 1.

TABLE 5

| SURFACE NUMBER | CURV | K | A |
|---|---|---|---|
| S3 | 0.7424 | 0.000 | −4.946E−02 |
| S5 | 0.7030 | 0.000 | −1.123E−01 |

Table 6 shows specifications of the optical system used in the specific example. Here, the wavelength denotes the wavelength of the light beam emitted from the light emitting element. The number of lines along which the lens are arranged in the arranging direction WW, namely the number of lens lines is three, the same number as in the case shown in FIG. 7. Further, in the above specifications, the body height of 0.2 mm denotes that the simulation was executed in the condition that the light beam is emitted from the virtual light emitting element located with the body height of 0.2 mm. In this case, since the magnification is −0.5, the image height becomes −0.4 mm. Further, the maximum field angle is 4.46°, and the light path length is 9.51 mm.

TABLE 6

| ITEM | VALUE |
|---|---|
| WAVELENGTH | 632.5 nm |
| NUMBER OF LENS LINES | 3 LINES |
| BODY HEIGHT | 0.2 mm |
| IMAGE HEIGHT | −0.4 mm |

TABLE 6-continued

| ITEM | VALUE |
|---|---|
| MAGNIFICATION | −0.5 |
| MAXIMUM FIELD ANGLE | 4.46° |
| LIGHT PATH LENGTH | 9.815 mm |

Also in the fourth embodiment configured as described above, the same advantages as the advantages in the first embodiment can be obtained. Moreover, in the present embodiment, since the surface S6 of the microlens array 299 opposed to the surface of the photoconductor drum is a planar surface, the following advantage can further be obtained. That is, the scattered toner particles can be prevented from adhering to and accumulating on the surface of the microlens array 299. Therefore, the line head 29 thus configured can prevent the problem caused by the scattered toner particles from occurring, and is therefore preferable. Further, in addition to the line head 29 thus configured, a following cleaning mechanism (a cleaning section) described below can also be provided.

Fifth Embodiment

Figure 16:
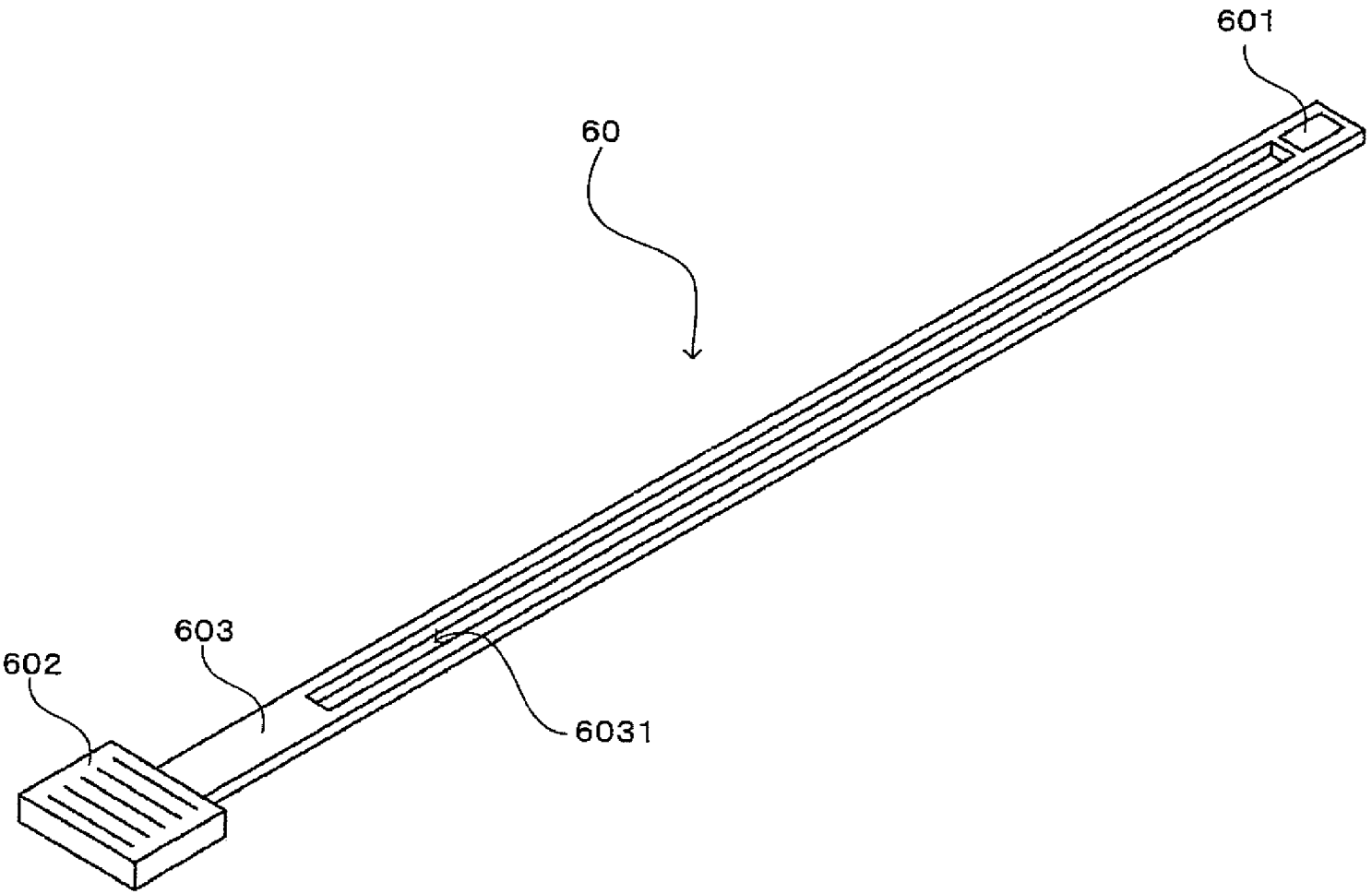
FIG. 16 is a perspective view of a cleaning member.

FIG. 16 is a perspective view of the cleaning mechanism. The cleaning mechanism 60 cleans a surface of the microlens array 299 on the photoconductor drum surface side. Specifically, the cleaning mechanism 60 is provided with a cleaning pad 601 and a handle section 602. The material of the cleaning pad 601 is artificial leather. Here, as the artificial leather, Ecsaine (registered trademark) produced by Toray industries, Inc. can be used. Further, the cleaning pad 601 and the handle section 602 are connected to each other by a connection member 603. Further, the connection member 603 is provided with a hollow section 6031 bored therethrough.

Figure 17:
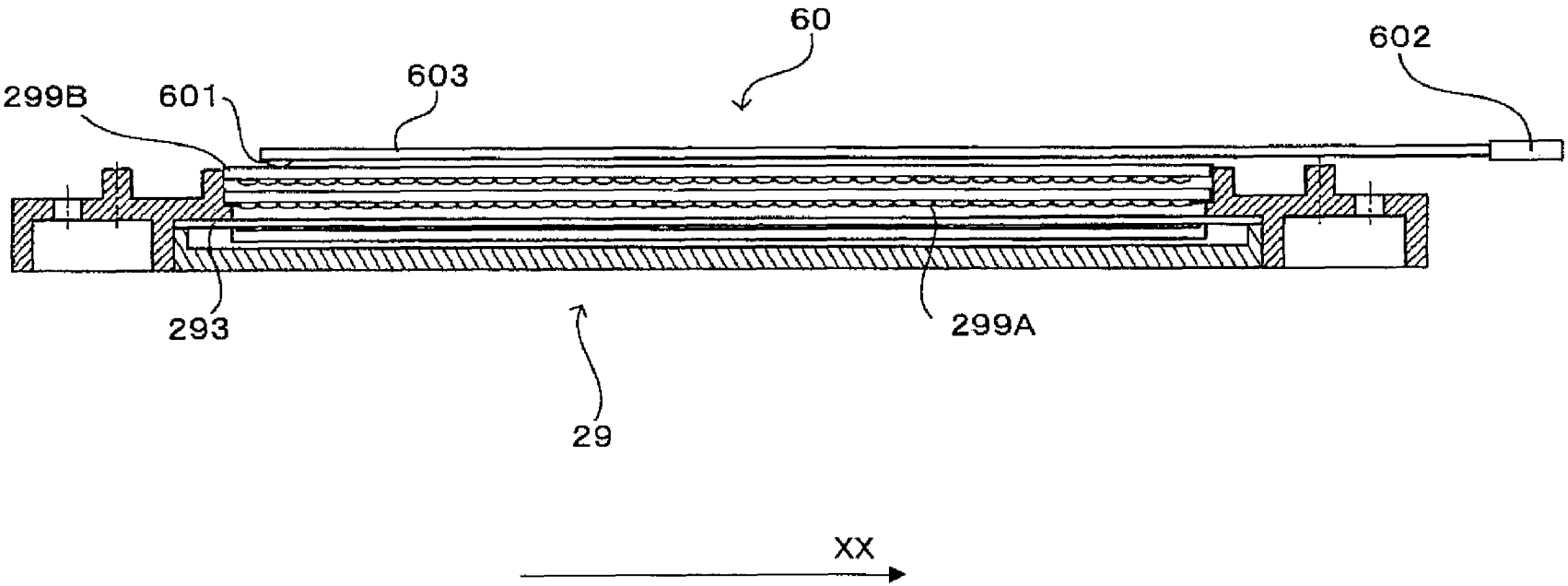
FIG. 17 is a diagram showing a cleaning operation with the cleaning member.

FIG. 17 is a diagram showing a cleaning operation with the cleaning member. As shown in the drawing, the cleaning mechanism 60 is disposed to the line head 29 so that the direction along which the connection member 603 extends is parallel to the main scanning direction XX. Further, the cleaning pad 601 has contact with the surface S6 of the microlens array 299 on the photoconductor drum surface side (the latent image holding unit surface side). Further, by the operator moving the handle section 602 in the longitudinal direction, the cleaning pad 601 moves in a direction corresponding to the main scanning direction XX while keeping contact with the surface S6. Therefore, the scattered toner particles adhered to the lens surface S6 can be scratched out to be removed by the cleaning pad 601.

As described above, the configuration further provided with the cleaning mechanism 60 can remove the toner particles adhered to the lens surface S6 with the cleaning mechanism 60 even if the scattered toner particles adhere to a surface of a transparent member of the microlens array 299 on the photoconductor drum surface side, and is therefore preferable.

It should be noted that the invention is not limited to the embodiments and the modified examples, but can variously be modified besides the contents described above within the scope of the invention. In the embodiments and the modified examples described above, as shown in FIG. 9, a plurality of light emitting element groups 295 each composed of a plurality of light emitting elements 2951 is provided. Each of the light emitting element groups 295 is composed by arranging two lines of light emitting elements L2951 in the sub-scanning direction YY with a predetermined distance, each of the lines of light emitting elements L2951 being composed by arranging four light emitting elements 2951 in the main scanning direction XX at constant element pitches DP such as pitches DP1, DP2, and DP3. In other words, the eight light emitting elements 2951 form the light emitting element group 295 corresponding to the microlens ML indicated by a chain double-dashed line circle. However, the number of the light emitting elements 2951 forming the light emitting element group 295, the number of the light emitting element lines L2951, or the arrangement of the plurality of light emitting elements 2951 and the plurality of light emitting element lines L2951 are not limited thereto, but can arbitrarily be modified. It should be noted that regarding the arrangement of the plurality of light emitting elements 2951, as described above, the symmetrical arrangement is preferably adopted because the preferable spot can easily be realized.

Further, as shown in FIG. 9, the plurality of light emitting element groups 295 is arranged as described below. That is, the light emitting element groups 295 are arranged in a two-dimensional manner so that three lines of light emitting element groups L295 (a group line) are arranged in the sub-scanning direction YY, each of the three lines of light emitting element groups L295 being composed by arranging a predetermined number (two or more) of light emitting element groups in the main scanning direction XX. However, the form of the arrangement of the plurality of light emitting element groups 295 is not limited thereto, but can arbitrarily be modified.

Further, although in the embodiments and the modified examples described above, the organic EL devices are used as the light emitting elements 2951, light emitting diodes other than the organic light emitting elements can also be used as the light emitting elements 2951.

Further, in the embodiments and the modified examples described above, the plurality of light emitting elements 2951 and the plurality of light emitting element groups 295 are formed on the reverse surface of the glass substrate 293, but is not so limited, and can be formed on the obverse surface of the glass substrate 293 depending on the types of the light emitting elements 2951. Further, in the case in which the plurality of light emitting elements 2951 and the plurality of light emitting element groups 295 are formed on the obverse surface of the substrate, a substrate made of metal or ceramics can be used instead of the glass substrate.

Further, although the inside surface with the shape 2971A, 2971B, or 2971C shown in FIG. 6, 12 or 13 is used in the embodiments or the modified examples described above, the inside surface is not limited thereto, but can arbitrarily be modified providing the loci of the light beams having contact with the inner end DH1 of the aperture section DH are not shielded.

Further, although in the embodiments and the modified example described above, the magnifying optical system is adopted as the imaging lens, this is not an essential requirement for the invention. Specifically, a minification optical system with a magnification (an optical magnification) of less than one or an equi-magnification optical system with a magnification of about one can be used as the imaging lens.

Further, although in the embodiments and the modified examples described above, the embodiment of the invention is applied to the image forming device 1 for forming a color image, the application target of the embodiment of the invention is not limited thereto, but the embodiment of the invention can also be applied to the image forming device of monochrome image formation for forming a so-called plain color image.

The entire disclosure of Japanese Patent Application Nos: 2007-15938, filed Jan. 26, 2007 and 2007-258912, filed Oct. 2, 2007 are expressly incorporated by reference herein.

What is claimed is:

1. A print head comprising:

a plurality of light emitting element groups each comprising a plurality of light emitting elements and disposed by the light emitting group;

a plurality of optical systems corresponding respectively to the light emitting element groups, the optical systems imaging light beams emitted from the corresponding light emitting element groups on a scan target surface, the optical systems each comprising a plurality of lenses;

a light shielding member provided with light guide holes corresponding respectively to the light emitting element groups, the light guide holes guiding the light beams emitted from the corresponding light emitting element groups to the corresponding optical systems; and a plurality of aperture sections each disposed at a front focal position of each of the optical systems, the aperture sections each passing the light beams emitted from the light emitting elements of the corresponding light emitting element group.

2. The print head according to claim 1, wherein the aperture sections are provided in the light guide holes.

3. The print head according to claim 1, wherein the light guide hole has an inside surface allowing loci of the light beams having contact with an inner end of the aperture section to proceed without being shielded by the inside surface of the light guide hole.

4. The print head according to claim 1, wherein the light shielding member comprises a layered body of a plurality of thin plates.

5. The print head according to claim 4, wherein the aperture section is an opening provided to one of the plurality of thin plates.

6. The print head according to claim 1, wherein a lens of the plurality of lenses facing to the scan target surface has a planar surface.

7. The print head according to claim 6, further comprising a cleaning section that cleans the planar surface facing to the scan target surface.

8. The print head according to claim 1, wherein an aperture area of the aperture section is smaller than opening areas of the light guide holes on both a light emitting element side and an optical system side from the aperture section.

9. The print head according to claim 8, wherein the opening area of the light guide hole on the light emitting element side is smaller than the opening area of the light guide hole on the optical system side.

10. An image forming device comprising:

a latent image holding unit having a surface fed in a predetermined feeding direction; and a print head for forming a latent image on the surface of the latent image holding unit, wherein the print head including a plurality of light emitting element groups each comprising a plurality of light emitting elements and disposed by the light emitting group, a plurality of optical systems corresponding respectively to the light emitting element groups, the optical systems imaging light beams emitted from the corresponding light emitting element groups on the surface of the latent image holding unit, the optical systems each comprising a plurality of lenses, a light shielding member provided with light guide holes corresponding respectively to the light emitting element groups, the light guide holes guiding the light beams emitted from the corresponding light emitting element groups to the corresponding optical systems, and a plurality of aperture sections each disposed at a front focal position of each of the optical systems, the aperture sections each passing the light beams emitted from the light emitting elements of the corresponding light emitting element group.

11. The image forming device according to claim 10, wherein the aperture sections are provided in the light guide holes.

12. The image forming device according to claim 10, wherein the light guide hole has an inside surface allowing loci of the light beams having contact with an inner end of the aperture section to proceed without being shielded by the inside surface of the light guide hole.

13. The image forming device according to claim 10, wherein the light shielding member comprises a layered body of a plurality of thin plates.

14. The image forming device according to claim 10, wherein a lens of the plurality of lenses facing to the latent image holding unit has a planar surface.

15. The image forming device according to claim 14, further comprising a cleaning section that cleans the planar surface facing to the latent image holding unit.

16. The image forming device according to claim 10, wherein an aperture area of the aperture section is smaller than opening areas of the light guide holes on both the light emitting element side and the optical system side from the aperture section.

* * * * *